US011701759B2

(12) United States Patent
Kato et al.

(10) Patent No.: US 11,701,759 B2
(45) Date of Patent: Jul. 18, 2023

(54) ELECTRIC POWER TOOL

(71) Applicant: MAKITA CORPORATION, Anjo (JP)

(72) Inventors: Itsuku Kato, Anjo (JP); Yasuhito Kawai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 109 days.

(21) Appl. No.: 17/026,390

(22) Filed: Sep. 21, 2020

(65) Prior Publication Data

US 2021/0094158 A1 Apr. 1, 2021

(30) Foreign Application Priority Data

Sep. 27, 2019 (JP) ..... 2019-177316

(51) Int. Cl.

| | |
|---|---|
| ***B25B 21/02*** | (2006.01) |
| ***B25B 23/147*** | (2006.01) |
| ***B25B 23/14*** | (2006.01) |
| ***B25F 5/00*** | (2006.01) |

(52) U.S. Cl.

CPC ..... *B25B 21/02* (2013.01); *B25B 23/1475* (2013.01); *B25B 23/1405* (2013.01); *B25D 2250/221* (2013.01); *B25F 5/001* (2013.01)

(58) Field of Classification Search

CPC ..... B25B 21/02; B25B 21/00; B25B 21/026; B25B 23/16; B25B 23/147; B25B 23/1475; B25B 23/1453; B25B 23/1405; B25B 19/00; B25D 2250/221; B25D 11/04; B25D 11/066; B25D 16/00; B25D 16/003; B25D 16/006; B25D 2216/0023; B25F 5/026; B25F 5/001

See application file for complete search history.

(56) References Cited

U.S. PATENT DOCUMENTS 2,373,664 A * 4/1945 Emery ..... B25B 21/02 173/93.5
2,373,667 A * 4/1945 Emery ..... B25B 23/1405 173/13
2,564,224 A * 8/1951 Mitchell ..... F16D 43/06 81/466

(Continued)

FOREIGN PATENT DOCUMENTS

CN 102348536 A 2/2012
CN 105983937 A 10/2016

(Continued)

OTHER PUBLICATIONS

Mar. 28, 2023 Notice of Reasons for Refusal issued in Japanese Patent Application No. 2019-177315.

(Continued)

*Primary Examiner* — Dariush Seif
(74) *Attorney, Agent, or Firm* — Oliff PLC

(57) ABSTRACT

An electric power tool in one aspect of the present disclosure includes a motor, an impact mechanism, and a control circuit. The control circuit executes a motor control process. The motor control process includes limiting an output of the motor in response to establishment of a preset condition. The preset condition is based on a load applied to the motor.

14 Claims, 20 Drawing Sheets

(56) References Cited

U.S. PATENT DOCUMENTS 2,825,436 A * 3/1958 Amtsberg ..... B25B 21/026 173/93
2,881,884 A * 4/1959 Amtsberg ..... B25B 21/026 173/93.6
2,973,071 A * 2/1961 Sturrock ..... B25B 21/026 173/93.6
3,068,973 A * 12/1962 Maurer ..... B25B 21/02 477/166
3,070,201 A * 12/1962 Spyridakis ..... B25B 21/026 173/93
3,156,334 A * 11/1964 Hoza ..... B25B 21/02 192/113.1
3,250,153 A * 5/1966 Purkey ..... B25H 1/0057 408/100
3,352,368 A * 11/1967 Maffey, Jr. ..... B25B 21/00 D8/68
3,362,486 A * 1/1968 Alajouanine ..... B25B 23/1453 173/93.5
3,369,615 A * 2/1968 Maffey, Jr. ..... B25F 5/02 173/93.6
3,606,931 A * 9/1971 Karden ..... B25B 21/026 173/93.5
3,648,784 A * 3/1972 Schoeps ..... B25B 21/026 173/93.5
3,804,180 A * 4/1974 Gelfand ..... B25B 21/02 173/15
4,002,212 A * 1/1977 Schoeps ..... B25B 21/02 173/93.5
4,276,675 A * 7/1981 Pioch ..... B25F 5/026 74/544
4,314,782 A * 2/1982 Beekenkamp ..... B25H 1/0078 D15/138
4,505,170 A * 3/1985 Van Laere ..... B25B 21/02 81/464
4,619,162 A * 10/1986 Van Laere ..... B25F 3/00 173/104
4,719,976 A * 1/1988 Bleicher ..... B25D 16/003 173/205
4,905,423 A * 3/1990 van Laere ..... B25F 5/001 81/464
4,977,966 A * 12/1990 Farber ..... B25B 21/026 173/159
5,049,012 A * 9/1991 Cavedo ..... B25F 5/026 408/241 R
5,092,410 A * 3/1992 Wallace ..... B25B 21/02 81/463
D343,345 S * 1/1994 Ogawa ..... D8/69
5,836,403 A * 11/1998 Putney ..... B25B 21/02 173/205
5,888,031 A * 3/1999 Buck ..... B25F 5/026 408/110
6,104,114 A * 8/2000 Takeda ..... H02K 21/16 310/90
6,138,772 A * 10/2000 Miescher ..... B25D 16/00 173/205
6,158,526 A * 12/2000 Ghode ..... B25B 21/026 173/109
6,546,815 B2 * 4/2003 Yamada ..... B25B 21/02 73/862.21
6,553,627 B1 * 4/2003 Horler ..... B25G 1/00 16/427
6,786,683 B2 * 9/2004 Schaer ..... B23B 49/006 408/8
7,032,685 B2 * 4/2006 Nakamizo ..... B25B 23/1453 464/37
7,259,486 B2 * 8/2007 Yamamoto ..... F04D 29/5806 310/90
D590,681 S * 4/2009 Palermo ..... D8/68
D591,130 S * 4/2009 Palermo ..... D8/69
D606,377 S * 12/2009 Ho ..... D8/69
7,673,702 B2 * 3/2010 Johnson ..... B25B 21/00 173/109
7,823,256 B2 * 11/2010 Engelfried ..... B25F 5/026 16/426
7,905,377 B2 * 3/2011 Krondorfer ..... B25C 1/06 173/90
7,918,286 B2 * 4/2011 Nagasaka ..... B25B 21/02 173/109
7,934,566 B2 * 5/2011 Hlinka ..... B25C 1/06 173/90
8,032,990 B2 * 10/2011 Shinma ..... B25F 5/026 16/426
8,069,929 B2 * 12/2011 Sugimoto ..... B25B 21/026 81/463
8,127,974 B2 * 3/2012 Zhang ..... B25C 1/06 227/129
8,371,394 B2 * 2/2013 Grand ..... B25B 21/02 173/29
8,371,708 B2 * 2/2013 Nagasaka ..... B25B 23/18 173/217
8,407,860 B2 * 4/2013 Brennenstuhl ..... B25F 5/026 16/422
8,460,153 B2 * 6/2013 Rudolph ..... B25B 21/02 475/344
8,584,770 B2 * 11/2013 Zhang ..... B23Q 5/04 173/178
8,827,003 B2 * 9/2014 Nagasaka ..... B25B 21/023 173/202
8,925,645 B2 * 1/2015 Harada ..... B25B 23/1405 173/9
8,925,646 B2 * 1/2015 Seith ..... B25B 21/02 173/217
8,961,358 B2 * 2/2015 Hirabayashi ..... B25B 21/008 475/300
9,114,521 B2 * 8/2015 Yoshikawa ..... B25F 5/02
9,308,638 B2 * 4/2016 Kondo ..... B25F 5/02
9,321,159 B2 * 4/2016 May ..... B25B 23/1475
9,393,711 B2 * 7/2016 Myrhum, Jr. ..... B26D 5/086
9,415,497 B2 * 8/2016 Hecht ..... B25D 16/003
9,463,566 B2 * 10/2016 Yoshikane ..... B25G 1/01
9,566,692 B2 * 2/2017 Seith ..... B25B 21/02
9,643,300 B2 * 5/2017 Kumagai ..... B25B 21/02
9,849,577 B2 * 12/2017 Wyler ..... B25D 11/125
D835,959 S * 12/2018 Eardley ..... D8/67
10,295,990 B2 * 5/2019 Dey, IV ..... G06F 3/04817
D853,815 S * 7/2019 Yaschur ..... D8/69
10,654,153 B2 * 5/2020 Murakami ..... B25B 21/02
2001/0004939 A1 * 6/2001 Durmeyer ..... E02D 7/06 173/217
2002/0035876 A1 * 3/2002 Donaldson, Jr. .... B25B 23/1456 73/862.21
2005/0109519 A1 * 5/2005 Kawai ..... B25B 21/026 173/183
2005/0121209 A1 * 6/2005 Shimizu ..... B25B 21/00 173/217
2005/0263305 A1 * 12/2005 Shimizu ..... B25B 21/02 173/176
2006/0090913 A1 * 5/2006 Furuta ..... B25D 16/003 173/48
2006/0185869 A1 * 8/2006 Arimura ..... B25B 23/1475 173/176
2007/0000676 A1 * 1/2007 Arimura ..... B25B 23/1475 173/179
2007/0209162 A1 * 9/2007 McRoberts ..... B25F 5/026 16/426
2007/0267206 A1 * 11/2007 Chen ..... B25B 21/00 173/170
2008/0078067 A1 * 4/2008 Nicolantonio ..... B25F 5/026 16/110.1
2008/0099217 A1 * 5/2008 Seith ..... B25B 21/026 173/1
2009/0000434 A1 * 1/2009 Shinma ..... B25D 17/04 81/491
2009/0133894 A1 * 5/2009 Mizuhara ..... B25F 5/006 310/156.01
2009/0178520 A1 * 7/2009 Engelfried ..... B25D 17/04 81/489

(56) References Cited

U.S. PATENT DOCUMENTS

2010/0005629 A1* 1/2010 Di Nicolantonio ..... B25F 5/026 16/426
2010/0064482 A1* 3/2010 Martin ..... B25F 5/026 16/426
2010/0096155 A1* 4/2010 Iwata ..... B25B 21/02 173/217
2010/0307782 A1* 12/2010 Iwata ..... H02P 29/0241 173/217
2011/0011609 A1* 1/2011 Simm ..... B25F 5/026 173/171
2011/0073334 A1* 3/2011 Iimura ..... B25B 21/02 173/217
2011/0079407 A1* 4/2011 Iimura ..... B25B 23/1405 173/217
2011/0120741 A1* 5/2011 Limberg ..... B25F 5/02 16/421
2011/0188232 A1* 8/2011 Friedman ..... H02K 16/005 362/119
2011/0284255 A1* 11/2011 Ookubo ..... H02P 23/03 173/117
2011/0315417 A1* 12/2011 Matsunaga ..... B25B 21/008 173/176
2012/0073846 A1* 3/2012 Hirai ..... B25B 21/02 173/200
2012/0132452 A1* 5/2012 Hoop ..... B25B 21/026 173/93.5
2012/0199372 A1* 8/2012 Nishikawa ..... B25B 21/02 173/132
2012/0234566 A1* 9/2012 Mashiko ..... B25B 21/02 173/93.5
2012/0279736 A1* 11/2012 Tanimoto ..... B25B 21/026 173/117
2012/0292065 A1* 11/2012 Hoshi ..... B25B 21/02 173/93
2012/0292070 A1* 11/2012 Ito ..... H02K 11/33 173/217
2012/0318549 A1* 12/2012 Nagasaka ..... B25F 5/02 173/109
2012/0318550 A1* 12/2012 Tanimoto ..... B25B 23/1475 173/117
2012/0319508 A1* 12/2012 Oomori ..... B25B 21/02 310/50
2013/0000934 A1* 1/2013 Tadokoro ..... B25B 21/00 173/90
2013/0008679 A1* 1/2013 Nishikawa ..... B25B 21/02 173/93
2013/0014967 A1* 1/2013 Ito ..... B25F 5/00 173/93
2013/0025892 A1* 1/2013 Mashiko ..... B25B 21/026 173/2
2013/0062086 A1* 3/2013 Ito ..... B25B 23/1475 173/1
2013/0062088 A1* 3/2013 Mashiko ..... B25B 21/02 173/48
2013/0075121 A1* 3/2013 Nakamura ..... B25B 21/02 173/94
2013/0087355 A1* 4/2013 Oomori ..... B25B 21/02 173/94
2013/0126202 A1* 5/2013 Oomori ..... B25B 21/00 173/217
2013/0133911 A1* 5/2013 Ishikawa ..... B25B 21/026 173/176
2013/0139614 A1* 6/2013 Johnson ..... B23P 19/066 73/862.21
2013/0186661 A1* 7/2013 Okubo ..... B25F 5/00 173/2
2013/0233584 A1* 9/2013 Mashiko ..... B25F 5/001 173/181
2013/0270932 A1* 10/2013 Hatfield ..... H02K 11/30 310/50
2013/0270934 A1* 10/2013 Smith ..... H02K 7/145 310/50
2013/0333910 A1* 12/2013 Tanimoto ..... B25B 23/1475 173/176
2014/0069672 A1* 3/2014 Mashiko ..... B25B 21/00 173/47
2014/0124229 A1* 5/2014 Takahashi ..... B25B 21/02 173/93.5
2014/0131059 A1* 5/2014 Verbrugge ..... B25F 5/00 173/217
2014/0144658 A1* 5/2014 Schmid ..... B25D 17/06 173/90
2014/0145524 A1* 5/2014 Tanimoto ..... H02K 1/2706 310/50
2014/0158388 A1* 6/2014 Johnson ..... B25B 21/02 173/1
2014/0158390 A1* 6/2014 Mashiko ..... B25B 23/147 173/217
2014/0182869 A1* 7/2014 Kumagai ..... B25F 5/001 173/93
2014/0224075 A1* 8/2014 Merrick ..... B25B 13/461 81/52
2014/0251649 A1* 9/2014 Kondo ..... B23Q 9/00 16/426
2014/0318821 A1* 10/2014 Wyler ..... B25F 5/006 173/104
2014/0371018 A1* 12/2014 Ito ..... B25F 5/008 475/149
2014/0374130 A1* 12/2014 Nakamura ..... B25B 23/1475 173/176
2015/0000946 A1* 1/2015 Amend ..... B25D 11/04 173/93
2015/0022125 A1* 1/2015 Takano ..... H02P 29/68 318/139
2015/0041169 A1* 2/2015 Kumagai ..... B25B 21/026 173/93.7
2015/0047866 A1* 2/2015 Sakai ..... B25B 21/02 173/217
2015/0075829 A1* 3/2015 Seith ..... B25B 21/026 173/109
2015/0083448 A1* 3/2015 Chen ..... B25B 23/1475 81/464
2015/0083451 A1* 3/2015 Nishikawa ..... B25D 16/006 173/48
2015/0122522 A1* 5/2015 Fujimoto ..... B25B 21/00 173/1
2015/0144365 A1* 5/2015 Hirabayashi ..... B25B 23/1405 173/2
2015/0158160 A1* 6/2015 Kato ..... B25C 1/06 91/55
2015/0174753 A1* 6/2015 Kamiya ..... B25F 5/008 16/426
2015/0209952 A1* 7/2015 Nishii ..... B25F 5/026 173/162.2
2015/0231770 A1* 8/2015 Kusakawa ..... B25B 21/02 173/93.5
2015/0231771 A1* 8/2015 Sakai ..... B25B 21/02 173/176
2015/0266176 A1* 9/2015 Takeuchi ..... B25D 17/24 173/117
2015/0298308 A1* 10/2015 Kato ..... B25C 1/06 318/484
2015/0303842 A1* 10/2015 Takano ..... B25F 5/008 173/2
2015/0333664 A1* 11/2015 Bantie ..... B25F 5/02 318/287
2015/0336249 A1* 11/2015 Iwata ..... B25B 23/1475 173/1
2015/0343617 A1* 12/2015 Kondo ..... B25B 21/02 173/93
2015/0352699 A1* 12/2015 Sakai ..... B25B 21/026 173/176
2015/0372633 A1* 12/2015 Machida ..... H02P 29/20 173/48
2016/0008961 A1* 1/2016 Takano ..... B25F 5/00 173/2
2016/0075004 A1 3/2016 Tsubakimoto et al.

(56) References Cited

U.S. PATENT DOCUMENTS

2016/0079887 A1* 3/2016 Takano ..... B25F 5/008 318/431
2016/0107297 A1* 4/2016 Ishikawa ..... B25B 21/008 173/179
2016/0129568 A1* 5/2016 Nishikawa ..... B25B 21/026 173/93
2016/0190965 A1* 6/2016 Miyazaki ..... H02P 1/00 318/14
2016/0250743 A1* 9/2016 Kikuchi ..... B25F 5/02 173/46
2016/0311102 A1* 10/2016 Ebner ..... H01M 50/247
2016/0325415 A1* 11/2016 Huber ..... B25B 23/1475
2016/0342151 A1* 11/2016 Dey, IV ..... G06F 3/0482
2016/0354905 A1* 12/2016 Ely ..... B25B 21/008
2017/0008156 A1* 1/2017 Miyazaki ..... B25B 23/1475
2017/0021478 A1* 1/2017 Junkers ..... F16B 39/24
2017/0028537 A1* 2/2017 McClung ..... B25B 21/026
2017/0036327 A1* 2/2017 Murakami ..... B25B 21/026
2017/0057064 A1* 3/2017 Ishikawa ..... B25B 23/1475
2017/0106517 A1* 4/2017 Machida ..... B25D 17/24
2017/0106525 A1* 4/2017 Brauer ..... B25G 1/06
2017/0144278 A1* 5/2017 Nishikawa ..... B25B 21/026
2017/0144289 A1* 5/2017 Yamashita ..... H01H 13/08
2017/0144290 A1* 5/2017 Tsutsui ..... B25F 5/00
2017/0151657 A1* 6/2017 Nagasaka ..... H02K 7/145
2017/0173768 A1* 6/2017 Dey, IV ..... B25B 23/1475
2017/0190027 A1* 7/2017 Koizumi ..... B25F 5/00
2017/0190028 A1* 7/2017 Howard ..... B25B 21/026
2017/0190032 A1* 7/2017 Leong ..... H02P 6/28
2017/0239801 A1* 8/2017 Kondo ..... B25B 21/02
2017/0246732 A1* 8/2017 Dey, IV ..... G01D 5/2006
2017/0326712 A1* 11/2017 Li ..... H02K 1/146
2017/0326720 A1* 11/2017 Kuroyanagi ..... B25B 21/02
2017/0348835 A1* 12/2017 Skelly ..... B25B 23/0078
2017/0361449 A1* 12/2017 Goble ..... G01C 19/08
2018/0001444 A1* 1/2018 Matsushita ..... B25F 5/00
2018/0099394 A1* 4/2018 Ichikawa ..... B25D 17/043
2018/0117745 A1* 5/2018 Murakami ..... B25D 11/04
2018/0152120 A1* 5/2018 Yabuguchi ..... H02P 6/24
2018/0200872 A1* 7/2018 Leong ..... B25B 21/002
2018/0222022 A1* 8/2018 Kumagai ..... B25D 11/04
2018/0297179 A1 10/2018 Osada et al.
2019/0030692 A1* 1/2019 Harada ..... B25B 23/1475
2019/0030696 A1* 1/2019 Seith ..... B25B 21/02
2019/0047132 A1 2/2019 Kumagai et al.
2019/0255687 A1* 8/2019 Schneider ..... B25B 21/026
2020/0009709 A1* 1/2020 Kumagai ..... B25B 21/02
2020/0122281 A1* 4/2020 Wierer ..... B25F 5/00
2020/0198100 A1* 6/2020 Schneider ..... B25B 21/026
2020/0262037 A1* 8/2020 Schneider ..... B25B 21/026
2021/0094158 A1* 4/2021 Kato ..... B25B 21/026
2021/0100170 A1* 4/2021 Suzuki ..... B25F 5/026
2021/0162571 A1* 6/2021 Kondo ..... B25B 21/026
2021/0237249 A1* 8/2021 Fischer ..... B25F 5/02
2021/0260733 A1* 8/2021 Fischer ..... B25B 23/1475
2021/0260734 A1* 8/2021 Kubale ..... B25F 5/026

FOREIGN PATENT DOCUMENTS

CN 109382779 A 2/2019
JP 2004-187379 A 7/2004
JP 2013-111729 A 6/2013
JP 2015-150671 A 8/2015
JP 2018-176373 A 11/2018
JP 2019-030947 A 2/2019
WO 2013-12098 A1 1/2013
WO 2015-133082 A1 9/2015

OTHER PUBLICATIONS

Apr. 12, 2023 Office Action issued in Chinese Patent Application No. 202011021340.4.

* cited by examiner

90

| TRIGGER PULLING AMOUNT (LEVEL) | TARGET ROTATIONAL SPEED / BASIC DUTY RATIO | | | | | | | | | | | | | | | |
|---|---|---|---|---|---|---|---|---|---|---|---|---|---|---|---|---|
| | SOFT MODE | | | | MEDIUM MODE | | | | HARD MODE | | | | MAX MODE | | | |
| | BEFORE IMPACT | | AFTER IMPACT | | BEFORE IMPACT | | AFTER IMPACT | | BEFORE IMPACT | | AFTER IMPACT | | BEFORE IMPACT | | AFTER IMPACT | |
| | Ta1 | BD1 | Ta2 | BD2 | Ta1 | BD1 | Ta2 | BD2 | Ta1 | BD1 | Ta2 | BD2 | Ta1 | BD1 | Ta2 | BD2 |
| 0 | 0 | 0% | 0 | 0% | 0 | 0% | 0 | 0% | 0 | 0% | 0 | 0% | 0 | 0% | 0 | 0% |
| 1 | 100 | 4% | 100 | 4% | 100 | 4% | 100 | 4% | 100 | 4% | 100 | 4% | 100 | 4% | 100 | 4% |
| 2 | 150 | 5% | 150 | 5% | 200 | 7% | 200 | 7% | 230 | 7.5% | 230 | 7.5% | 250 | 8% | 250 | 8% |
| 3 | 200 | 7% | 200 | 7% | 300 | 9% | 250 | 8% | 400 | 10% | 290 | 8.7% | 450 | 11% | 320 | 9.3% |
| 4 | 250 | 8% | 230 | 7.5% | 450 | 11% | 320 | 9.3% | 750 | 19% | 470 | 11.5% | 800 | 20% | 500 | 12% |
| 5 | 300 | 9% | 250 | 8% | 600 | 15% | 400 | 10% | 1100 | 27% | 700 | 17% | 1200 | 30% | 750 | 18% |
| 6 | 400 | 10% | 290 | 9% | 800 | 20% | 500 | 12% | 1400 | 35% | 950 | 24% | 1600 | 40% | 1050 | 26% |
| 7 | 500 | 12% | 350 | 9.5% | 1100 | 27% | 700 | 18% | 1800 | 45% | 1150 | 28.5% | 2100 | 52% | 1400 | 35% |
| 8 | 600 | 15% | 400 | 10% | 1400 | 35% | 950 | 24% | 2200 | 55% | 1500 | 37% | 2600 | 65% | 1700 | 43% |
| 9 | 800 | 20% | 500 | 12% | 1700 | 43% | 1100 | 27% | 2700 | 67% | 1750 | 43.5% | 3100 | 77% | 1900 | 47% |
| 10 | 1100 | 27% | 700 | 18% | 2100 | 52% | 1400 | 35% | 3200 | 80% | 2000 | 50% | 3700 | 92% | 2300 | 58% |

Ta1 : FIRST TARGET ROTATIONAL SPEED
Ta2 : SECOND TARGET ROTATIONAL SPEED
BD1 : FIRST BASIC DUTY RATIO
BD2 : SECOND BASIC DUTY RATIO

FIG. 6

ELECTRIC POWER TOOL

CROSS-REFERENCE TO RELATED APPLICATIONS

This application claims the benefit of Japanese Patent Application No. 2019-177316 filed on Sep. 27, 2019 with the Japan Patent Office, the entire disclosure of which is incorporated herein by reference.

BACKGROUND

The present disclosure relates to an electric power tool.

Japanese Unexamined Patent Application Publication No. 2018-176373 discloses a rotary impact tool. The rotary impact tool includes an impact mechanism. The impact mechanism includes a hammer and an anvil. The hammer rotates when receiving a rotational force of a motor. The anvil rotates when receiving a rotational force of the hammer. The anvil is attached to a tool bit. When the anvil receives a torque equal to or greater than a specified magnitude, the hammer impacts the anvil. The rotary impact tool configured as such can tighten the screw firmly to an object by impact on the anvil.

SUMMARY

In the rotary impact tool, mechanical parts of the rotary impact tool, such as planetary gears, sun gears, and internal gears, may be damaged.

In one aspect of the present disclosure, it is preferable that damages to an electric power tool can be inhibited.

An electric power tool in one aspect of the present disclosure includes a motor, an impact mechanism, and/or a control circuit.

The impact mechanism includes a hammer and an anvil. The hammer is rotated by the motor. The anvil rotates when receiving a rotational force of the hammer. The anvil is attached to a tool bit (a tool element). The hammer impacts (or strikes or hammers or blows) the anvil in a rotation direction of the hammer when the anvil receives a first torque. The first torque is equal to or greater than a preset magnitude. The first torque may have, for example, a specified value or more.

The control circuit is configured to control the motor. Specifically the control circuit executes a motor control process (or a tool control process). The motor control process includes limiting an output of the motor when a preset condition is established. The preset condition is based on a magnitude of a load applied to the motor.

In the electric power tool of the present disclosure configured as above, the output of the motor is limited when the preset condition is established. Thus, a large load is inhibited from being continuously applied to a mechanical part of the electric power tool. The large load is due to the output of the motor. Therefore, damages to the electric power tool can be inhibited.

The preset condition may be established when a first physical quantity reaches a threshold (or the first physical quantity is equal to or greater than the threshold). The first physical quantity may indicate the magnitude of the load. The threshold may be set in advance.

In the electric power tool of the present disclosure configured as above, the output of the motor is limited when the first physical quantity reaches the threshold. Thus, the large load (i.e., the load corresponding to the first physical amount equal to or greater than the threshold) is inhibited from being continuously applied to the mechanical part. Therefore, damages to the electric power tool can be inhibited.

The motor control process may include continuing to limit the output of the motor until the motor stops when the first physical quantity reaches the threshold. In the electric power tool configured as above, the large load is inhibited from being continuously applied to the mechanical part at least from when the first physical quantity first reaches the threshold until the motor stops. Damages to the electric power tool can be further inhibited.

The motor control process may include setting the output of the motor to a basic output. The motor control process may further include switching the output of the motor from the basic output to a first limited output when the first physical quantity reaches the threshold. The first limited output may have a magnitude smaller than a magnitude of the basic output by a first magnitude.

The motor control process may further include switching the output of the motor from the first limited output to a second limited output in response to (i) switching the output of the motor to the first limited output, and (ii) the first physical quantity reaching the threshold. The second limited output may have a magnitude smaller than the magnitude of the basic output by a second magnitude. The second magnitude may be greater than the first magnitude.

The motor control process may further include switching the output of the motor from the second limited output to a third limited output in response to (i) switching the output of the motor to the second limited output, and (ii) the first physical quantity reaching the threshold. The third limited output may have a magnitude smaller than the magnitude of the basic output by a third magnitude. The third magnitude may be greater than the second magnitude.

The magnitude of the load may correspond to a magnitude of the torque applied to the anvil. In other words, the load may be detected based on the torque applied to the anvil.

The magnitude of the load may correspond to a magnitude of electric current supplied to the motor. In other words, the load may be detected based on the current supplied to the motor.

The magnitude of the load may correspond to a reduced amount per unit time of an actual rotational speed of the motor. In other words, the load may be detected based on the reduced amount.

The control circuit may control a motor current based on a pulse width modulation (PWM) signal. The PWM signal may have a duty ratio. The motor current may be supplied to the motor to drive the motor. Limiting the output of the motor when the first physical quantity reaches the threshold may include reducing the duty ratio. In the electric power tool configured as above, the output of the motor can be limited by reducing the motor current.

The preset condition may be established when a lock (or fixing) of the anvil occurs. The lock (or the fixing) may include not causing the anvil to rotate while the motor control process is executed so that the motor rotates.

The control circuit may determine whether the lock has occurred. The preset condition may be established when the control circuit determines that the lock has occurred.

In the electric power tool configured as above, the output of the motor is limited when the lock occurs. Thus, the large load due to the output of the motor can be inhibited from being continuously applied to the mechanical part. Damages to the electric power tool can be inhibited.

The motor control process may include continuing to limit the output of the motor until the motor stops when the control circuit determines that the lock has first occurred. In the electric power tool configured as above, the large load due to the output of the motor in a state in which the lock has occurred can be inhibited from being continuously applied to the mechanical part at least from when it is determined that the lock has occurred until the motor is stopped. Damages to the electric power tool can be further inhibited.

The control circuit may determine whether the lock has occurred by the torque applied to the anvil.

The motor control process may include controlling the motor so that the actual rotational speed of the motor is consistent with a target rotational speed. The target rotational speed may be set in advance. Limiting the output of the motor when the preset condition is established may include reducing the target rotational speed. In the electric power tool configured as above, the output of the motor can be limited by reducing the actual rotational speed.

The electric power tool of the present disclosure may include a rotary impact tool, for example.

BRIEF DESCRIPTION OF THE DRAWINGS

Example embodiments of the present disclosure will be described hereinafter with reference to the accompanying drawings, in which:

FIG. 6 is a diagram showing a configuration of a setting table;

DETAILED DESCRIPTION OF EXEMPLARY EMBODIMENTS

First Embodiment

An impact driver 1 (hereinafter, "driver 1") of the present embodiment shown in FIG. 1 may be used, for example, to tighten a bolt, a nut, etc. to an object. The driver 1 is a kind of rotary impact tool.

Figure 1:
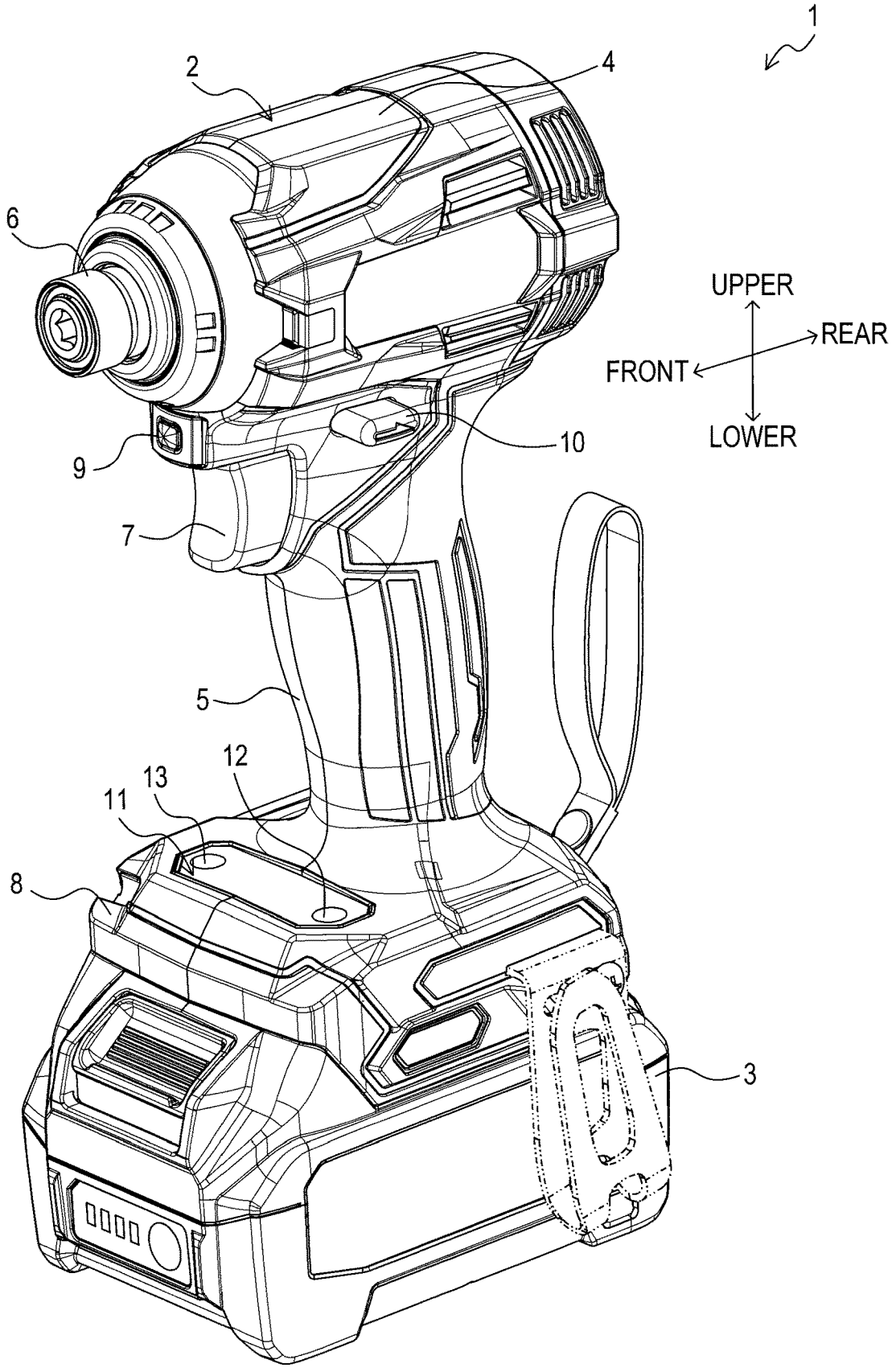
FIG. 1 is a perspective view of an impact driver.

As shown in FIG. 1, the driver 1 includes a tool main body 2 and a battery pack 3. The battery pack 3 may be detachably attached to the tool main body 2. The battery pack 3 supplies electric power to the tool main body 2.

The tool main body 2 includes a housing 4, a handgrip 5, a chuck sleeve 6, a trigger 7, a battery port 8, a mode-changing switch 9, a forward/reverse selector switch 10, and an operation panel 11.

The handgrip 5 is located in a lower area of the housing 4. The handgrip 5 is formed so that a user of the driver 1 can grip the handgrip 5 with one hand.

The chuck sleeve 6 is located in front of the housing 4. The chuck sleeve 6 is provided with an attachment mechanism at a front end portion thereof. The attachment mechanism is configured so that various tool bits (tool elements) are detachably attached to the attachment mechanism. Various tool bits may include, for example, a driver bit and a socket bit.

The trigger 7 is located on an upper front portion of the handgrip 5. The trigger 7 is configured to be operated by the user. The trigger 7 of the present embodiment is displaced, for example, by receiving a manual operation of the user. The manual operation on the trigger 7 can drive the driver 1. The trigger 7 is formed so that the user gripping the handgrip 5 can pull (or squeeze) the trigger 7 with the user's finger.

The battery port 8 is located at a lower end of the handgrip 5. The battery port 8 is configured so that the battery pack 3 is detachably attached to the battery port 8.

The mode-changing switch 9 is located above the trigger 7 in the handgrip 5. The mode-changing switch 9 is configured to be operated by the user. When the mode-changing switch 9 is operated once, an operation mode of the driver 1 is switched to one of pre-registered modes.

The forward/reverse selector switch 10 is located behind the mode-changing switch 9 in the handgrip 5. The forward/reverse selector switch 10 is configured to be operated by the user. When the forward/reverse selector switch 10 is operated, a rotation direction of the chuck sleeve 6 is switched to a either forward direction or a reverse direction. The forward direction (for example, clockwise direction) enables tightening of a screw. The reverse direction (for example, counterclockwise direction) enables loosening a tightened screw.

The operation panel 11 is located in the battery port 8. The operation panel 11 includes an impact button 12 and a special button 13. The impact button 12 and the special button 13 are configured to be operated (for example, depressed) by the user. When the impact button 12 or the special button 13 are operated, the operation mode of the driver 1 is set to one of the pre-registered modes.

Figure 2:
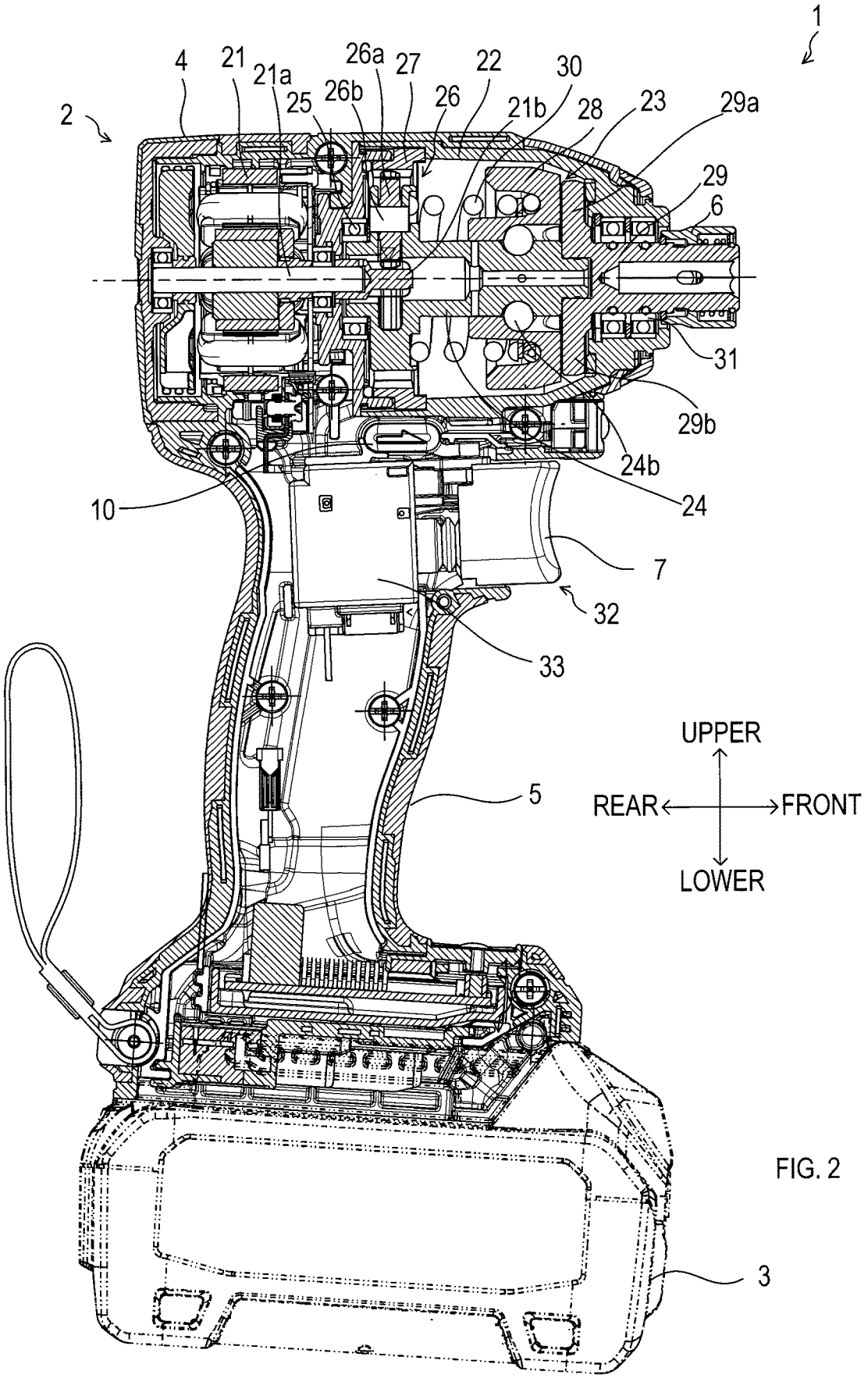
FIG. 2 is a sectional view showing a configuration of the impact driver.

As shown in FIG. 2, the driver 1 includes the motor 21, a hammer case 22, and the impact mechanism 23. The hammer case 22 has a bell-like shape. The housing 4 accommodates the motor 21, the hammer case 22, and the impact mechanism 23.

The hammer case 22 is assembled in front of the motor 21 (that is, right side of the motor 21 in FIG. 2).

The impact mechanism 23 is housed in the hammer case 22. The hammer case 22 coaxially houses a spindle 24. The spindle 24 has a hollow portion on a rear end side thereof. A ball bearing 25 is provided in the hammer case 22 on a rear end side thereof. The ball bearing 25 rotatably supports an outer periphery of the rear end side of the spindle 24.

Figure 3:
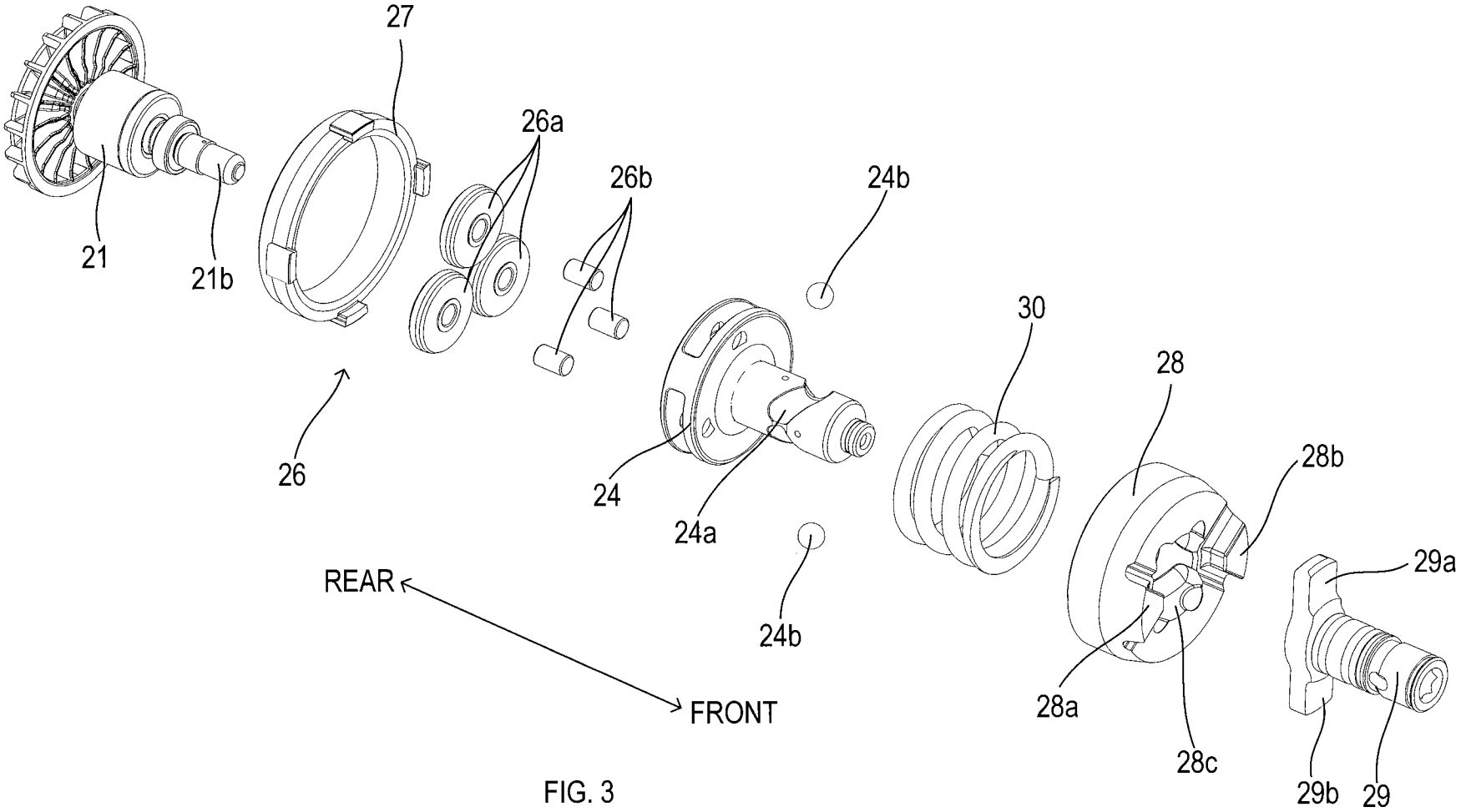
FIG. 3 is an exploded perspective view of an impact mechanism.

A planetary gear mechanism 26 is provided in front of the ball bearing 25. As shown in FIGS. 2 and 3, the planetary gear mechanism 26 includes a sun gear 21*b*, an internal gear 27, three planetary gears 26*a*, and three pins 26*b*. The three planetary gears 26*a* are rotatably supported so as to be symmetrical about a rotation axis of the planetary gear mechanism 26. Each of the planetary gears 26*a* is configured to mesh with the internal gear 27. The internal gear 27 is attached to an inner peripheral surface of a rear end side of the hammer case 22.

Each of the planetary gears 26*a* is further configured to mesh with the sun gear 21*b*. The sun gear 21*b* is formed at a leading end of an output shaft 21*a* of the motor 21.

As shown in FIGS. 2 and 3, the impact mechanism 23 includes the spindle 24, a hammer 28, an anvil 29, and a coil spring 30.

As shown in FIG. 3, the spindle 24 has a V-shaped spindle groove 24*a*. Two balls 24*b* are fitted in the spindle groove 24*a*. The hammer 28 has a hammer groove 28*c*. The two balls 24*b* are fitted in the hammer groove 28*c*.

As shown in FIG. 2, the hammer 28 is coupled to the spindle 24. The hammer 28 is integrally rotatable with the spindle 24, and further movable along a rotation axis of the spindle 24. FIG. 2 shows the hammer 28 being biased forward by the coil spring 30. In this case, the two balls 24*b* are arranged at a front end of the spindle groove 24*a*.

A front end portion of the spindle 24 is loosely and coaxially inserted in a rear end of the anvil 29. In other words, the front end portion of the spindle 24 is rotatably supported by the anvil 29.

The anvil 29 is configured to rotate about an axis thereof by receiving a rotational force and/or an impact force of the hammer 28. A bearing 31 is provided at a front end of the housing 4. The anvil 29 is supported, so as to be rotatable about the axis thereof and axially non-displaceable, by the bearing 31. The chuck sleeve 6 is attached to the front end of the anvil 29.

The output shaft 21*a* of the motor 21, the spindle 24, the hammer 28, the anvil 29, and the chuck sleeve 6 are all arranged so as to be coaxial with each other.

As shown in FIG. 3, the hammer 28 includes, for example, a first hammering protrusion 28*a* and a second hammering protrusion 28*b*. The first and second hammering protrusions 28*a* and 28*b* are configured to apply the rotational force and/or the impact force to the anvil 29. The first and second hammering protrusions 28*a* and 28*b* are arranged, for example, at 180° intervals with each other in a circumferential direction of the hammer 28. The first and second hammering protrusions 28*a* and 28*b* are arranged to protrude from a front end surface of the hammer 28.

As shown in FIGS. 2 and 3, a first hammering arm 29*a* and a second hammering arm 29*b*, for example, are provided on the rear end of the anvil 29. The first and second hammering arms 29*a* and 29*b* are arranged, for example, a 180° intervals with each other in the circumferential direction of the hammer 28.

When the hammer 28 is biased forward by a biasing force of the coil spring 30, the first and second hammering protrusions 28*a* and 28*b* can respectively contact the first and second hammering arms 29*a* and 29*b*. Surfaces of the first and second hammering protrusions 28*a* and 28*b* which the first and second hammering arms 29*a* and 29*b* respectively contact may be, for example, perpendicular to a rotation direction of the hammer 28. Surfaces of the first and second hammering arms 29*a* and 29*b* which the first and second hammering protrusions 28*a* and 28*b* contact may be, for example, perpendicular to a rotation direction of the anvil 29.

When the spindle 24 rotates by a rotational force of the motor 21 via the planetary gear mechanism 26 in a state in which the first and second hammering protrusions 28*a* and 28*b* respectively contact the first and second hammering arms 29*a* and 29*b*, the hammer 28 rotates together with the spindle 24. The rotational force of the hammer 28 is transmitted to the anvil 29 via the first hammering protrusion 28*a*, the second hammering protrusion 28*b*, the first hammering arm 29*a*, and the second hammering arm 29*b*.

This consequently causes a tool bit attached to a tip of the anvil 29 to rotate, and enables screw tightening.

When a screw is tightened to a specified depth, the anvil 29 may receive a first torque. The first torque is equal to or greater than a preset magnitude. In other words, the first torque has a value equal to or greater than a specified value (preset value). The first torque is applied to the anvil 29 in a direction opposite the rotation direction of the anvil 29. When the first torque is applied to the anvil 29, a second torque applied to the hammer 28 from the anvil 29 can also have a value equal to or greater than the specified value.

When the hammer 28 receives the torque having a magnitude equal to or greater than the specified magnitude from the anvil 29, the hammer 28 is displaced rearward against the biasing force of the coil spring 30. In this case, the hammer 28 is displaced rearward while rotating in a rotation direction opposite to the rotation direction of the spindle 24. When the hammer 28 is displaced rearward, the first and second hammering protrusions 28*a* and 28*b* respectively climb over the first and second hammering arms 29*a* and 29*b* in contact. In other words, the first and second hammering protrusions 28*a* and 28*b* temporarily disengage from the first and second hammering arms 29*a* and 29*b*. As a result, the hammer 28 idles. The aforementioned rearward displacement of the hammer 28 occurs by the balls 24*b* moving rearward together with the hammer 28.

The idling hammer 28 is displaced forward again due to the biasing force of the coil spring 30 while rotating in the same rotation direction as the spindle 24 together with the spindle 24. As a result, the first and second hammering protrusion 28*a* and 28*b* respectively strike the first and second hammering arm 29*a* and 29*b* in the rotation direction. The forward displacement of the hammer 28 occurs by the balls 24*b* moving forward together with the hammer 28.

Accordingly, every time the anvil 29 receives the first torque, the anvil 29 is struck (impacted) repeatedly by the hammer 28. Such intermittent application of the impact force of the hammer 28 to the anvil 29 enables a screw tightening at a high torque.

The trigger switch 32 includes the trigger 7 and a switch body 33.

Figure 4:
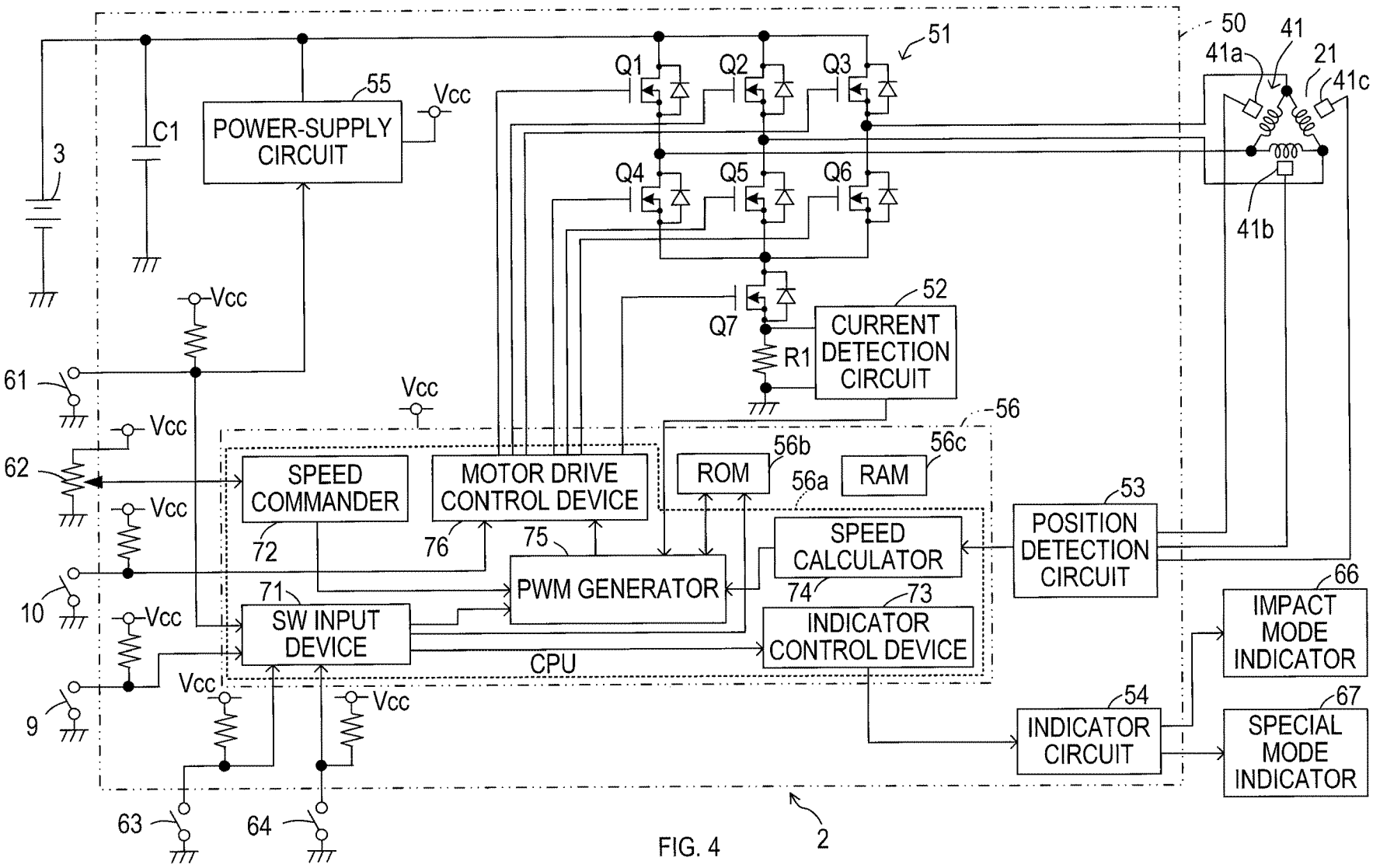
FIG. 4 is a block diagram showing an electrical configuration of a motor drive of a first, second, fifth, and sixth embodiments.

As shown in FIG. 4, the motor 21 is, for example, a three-phase brushless motor. The motor 21 may include three armature windings. The three armature windings may include a U-phase winding, a V-phase winding, and a W-phase winding. The tool main body 2 includes a rotation sensor 41. The rotation sensor 41 is provided to detect a rotational position (that is, rotation angle) of the motor 21. The rotation sensor 41 includes, for example, a first to third Hall sensors 41*a* to 41*c*. The respective first to third Hall sensors 41*a* to 41*c* are associated with the U-phase winding, the V-phase winding, and the W-phase winding. Each of the first to third Hall sensors 41*a* to 41*c* may include, for example, an integrated circuit (IC). The IC may include a Hall element. Each of the first to third Hall sensor 41*a* to 41*c* is configured to generate a rotation detection signal corresponding to the rotational position of the motor 21.

The tool main body 2 includes a motor drive 50 shown in FIG. 4. The motor drive 50 controls driving of the motor 21.

The switch body 33 includes a main switch 61 and an operated amount sensor (or displaced amount detector) 62 shown in FIG. 4. The main switch 61 is turned on when the trigger 7 is operated (i.e., when the trigger 7 is displaced). The operated amount sensor 62 is configured to detect a pulled amount (or displaced amount or operated amount) of the trigger 7. The operated amount sensor 62 may include a variable resistor. The variable resistor has a variable resistance value that may vary in accordance with the pulling amount of the trigger 7 (hereinafter, "trigger pulling amount"). The main switch 61 and the manual operation amount sensor 62 are coupled to the motor drive 50.

The tool main body 2 includes an impact switch 63 and a special switch 64 shown in FIG. 4. The impact switch 63 may be turned on when the impact button 12 is depressed. The special switch 64 may be turned on when the special button 13 is depressed. The impact switch 63 and the special switch 64 are coupled to the motor drive 50.

The mode-changing switch 9 and the forward/reverse selector switch 10 are coupled to the motor drive 50.

As shown in FIG. 4, the motor drive 50 includes drive circuit 51, a current detection circuit 52, a position detection circuit 53, an indicator circuit 54, a power-supply circuit 55, and a control circuit 56.

The drive circuit 51 is configured to receive an electric power from the battery pack 3, and deliver electric current to the U-phase winding, the V-phase winding, and the W-phase winding. In the present embodiment, the drive circuit 51 includes a three-phase full-bridge circuit. The three-phase full-bridge circuit includes a first to sixth switching elements Q1 to Q6. In the present embodiment, each of the first to sixth switching elements Q1 to Q6 is, for example, a metal oxide semiconductor field-effect transistor (MOSFET) but not limited to MOSFET.

In the drive circuit 51, the first to third switching elements Q1 to Q3 are so-called high-side switches. Specifically, the first switching element Q1 is coupled to, for example, a U-phase terminal of the motor 21 and a power-supply line. The power-supply line couples with a positive electrode of the battery pack 3. The second switching element Q2 is coupled to, for example, a V-phase terminal of the motor 21 and the power-supply line. The third switching element Q3 is coupled to, for example, a W-phase terminal of the motor 21 and the power-supply line.

The fourth to sixth switching elements Q4 to Q6 are so called low-side switches. Specifically, the fourth switching element Q4 is coupled to, for example, the U-phase terminal of the motor 21 and a ground line. The ground line couples with a negative electrode of the battery pack 3. The fifth switching element Q5 is coupled to, for example, the V-phase terminal of the motor 21 and the ground line. The sixth switching element Q6 is coupled to, for example, the W-phase terminal of the motor 21 and the ground line.

The motor drive 50 includes a capacitor C1. The capacitor C1 is coupled to the power-supply line. The capacitor C1 is provided in order to reduce voltage fluctuation in the power-supply line.

The ground line is coupled to a ground path having a seventh switching element Q7 and a resistor R1 thereon. The seventh switching element Q7 completes or interrupts the ground path. The current detection circuit 52 is configured to detect a voltage across the resistor R1 as a current detection signal, and output the current detection signal to the control circuit 56. The current detection signal indicates a value of electric current flowing through the resistor R1. The current detection signal when electric current is supplied from the battery pack 3 to the motor 21 indicates a value of electric current supplied from the battery pack 3 to the motor 21 (hereinafter, "motor current").

The position detection circuit 53 is configured to detect the rotational position of the motor 21 based on the rotation detection signal from the rotation sensor 41, and output the rotational position detected by the position detection circuit 53 to the control circuit 56 as a position detection signal.

The indicator circuit 54 is configured to turn on or off each of a later-described first to fifth LEDs 81 to 85 shown in FIG. 5, in accordance with a command from the control circuit 56.

The power-supply circuit 55 is configured to supply electric power to internal electric/electronic components of the motor drive 50. The power-supply circuit 55 is configured to receive electric power from the battery pack 3, and generate a power-supply voltage Vcc from the received electric power. The power-supply voltage Vcc is supplied to the control circuit 56, the indicator circuit 54, pull-up resistors, etc. The pull-up resistors are each coupled, for example, as shown in FIG. 4, to the mode-changing switch 9, the main switch 61, the forward/reverse selector switch 10, the impact switch 63, and the special switch 64.

The power-supply circuit 55 is activated when the main switch 61 is turned on. The activated power-supply circuit 55 stops operation thereof when the main switch 61, the mode-changing switch 9, the impact button 12, and the special button 13 are not operated for a given term.

The control circuit 56 includes a microcomputer containing a CPU 56*a*, a ROM 56*b*, and a RAM 56*c*. Various functions of the control circuit 56 are implemented by the CPU 56*a* executing programs stored in a non-transitory tangible storage medium. In the present embodiment, the ROM 56*b* corresponds to the non-transitory tangible storage medium. When a program stored in the ROM 56 is executed, a method corresponding to the program is executed. A part or all of the functions executed by the CPU 56*a* may be implemented by hardware. The hardware may include one or more of ICs. The control circuit 56 may include two or more microcomputers. The ROM 56*b* may be a rewritable non-volatile memory. The ROM 56*b* stores control characteristics of the motor 21. The control characteristics of the motor 21 may be associated with the respective pre-registered modes.

The control circuit 56 includes function blocks, a SW input device 71, a speed commander 72, an indicator control device 73, a speed calculator 74, a pulse-width modulation (PWM) generator 75, and a motor drive control device 76. Each of the function blocks corresponds to a function implemented by a software process executed by the CPU 56*a*.

The SW input device 71 is configured to detect ON and OFF of each of the main switch 61, the mode-changing switch 9, the impact switch 63, and the special switch 64. The SW input device 71 is configured to set the operation mode and LED states based on a detection result. The LED states indicate ON or OFF of each of the first to fifth LEDs 81 to 85. The SW input device 71 is configured to store in the ROM 56*b* information indicating the operation mode set by the SW input device 71. The SW input device 71 is configured to output to the indicator control device 73 LED state information indicating the LED states set by the SW input device 71.

The speed commander 72 is configured to detect the operated amount of the trigger 7 based on an input signal from the operated amount sensor 62, and output a speed command to instruct a rotational speed corresponding to the detected operated amount to the PWM generator 75.

The indicator control device 73 is configured to control the first to fifth LEDs 81 to 85 via the indicator circuit 54 in accordance with the input from the SW input device 71.

The speed calculator 74 is configured to calculate a motor speed based on the position detection signal from the position detection circuit 53. The motor speed corresponds to an actual rotational speed (or rotational frequency) of the motor 21. The speed calculator 74 is configured to output the calculated motor speed to the PWM generator 75.

The PWM generator 75 is configured to read from the ROM 56*b* the control characteristics corresponding to the operation mode set by the SW input device 71, and generate PWM signals in accordance with the read control characteristics. The PWM signals are control signals for driving the motor 21. In other words, the PWM signals are pulse width modulated signals in accordance with a value of electric current supplied to the motor 21.

In other words, the PWM generator 75 generates the PWM signals based on the read control characteristics and the inputted speed command and motor speed. More specifically, the PWM generator 75 calculates a drive duty ratio (first drive duty ratio DD1 or second drive duty ratio DD2) as later described. The PWM generator 75 generates the PWM signals based on the calculated drive duty ratio (for example, PWM signals having the drive duty ratio).

The motor drive control device 76 is configured to perform PWM driving of the drive circuit 51 in accordance with the PWM signals. The PWM driving means turning on or off the respective first to sixth switching elements Q1 to Q6 in accordance with the PWM signals. The PWM driving of the drive circuit 51 causes electric current to flow to the U-phase winding, the V-phase winding, and the W-phase winding, and rotates the motor 1. That is, the motor drive control device 76 executes a PWM control for energizing the motor 21.

The motor drive control device 76 is configured to switch a rotation direction of the motor 21 based on an input signal from the forward/reverse selector switch 10.

Hereinafter, the operation mode of the driver 1 will be described.

The driver 1, for example, includes ten types of the mode, that is, four impact modes and six special modes. The four impact modes include Max mode, Hard mode, Medium mode, and Soft mode. The six special modes include Wood mode, First Tex mode, Second Tex mode, First Bolt mode, Second Bolt mode, and Third Bolt mode. Tex is a registered trademark. The operation mode of the driver 1 can be set to one of the ten types of the mode.

Each of the ten types of the mode specifies a control method of the motor 21. In order to implement the control method defined for each mode, the control characteristics corresponding to each of the modes are preliminarily stored in the ROM 56*b*. The control method corresponding to each mode is implemented based on the corresponding control characteristics.

The user can set the operation mode to one of the four impact modes by operation of the impact button 12. The operation mode may be changed in an order of, for example, Max mode, Hard mode, Medium mode, Soft mode, and Max mode through operation of the impact button 12.

The user can set the operation mode to one of the six special modes by operation of the special button 13. The operation mode may be changed in an order of, for example, Wood mode, First Tex mode, Second Tex mode, First Bolt mode, Second Bolt mode, Third Bolt mode, and Wood mode through operation of the special button 13.

Figure 5:
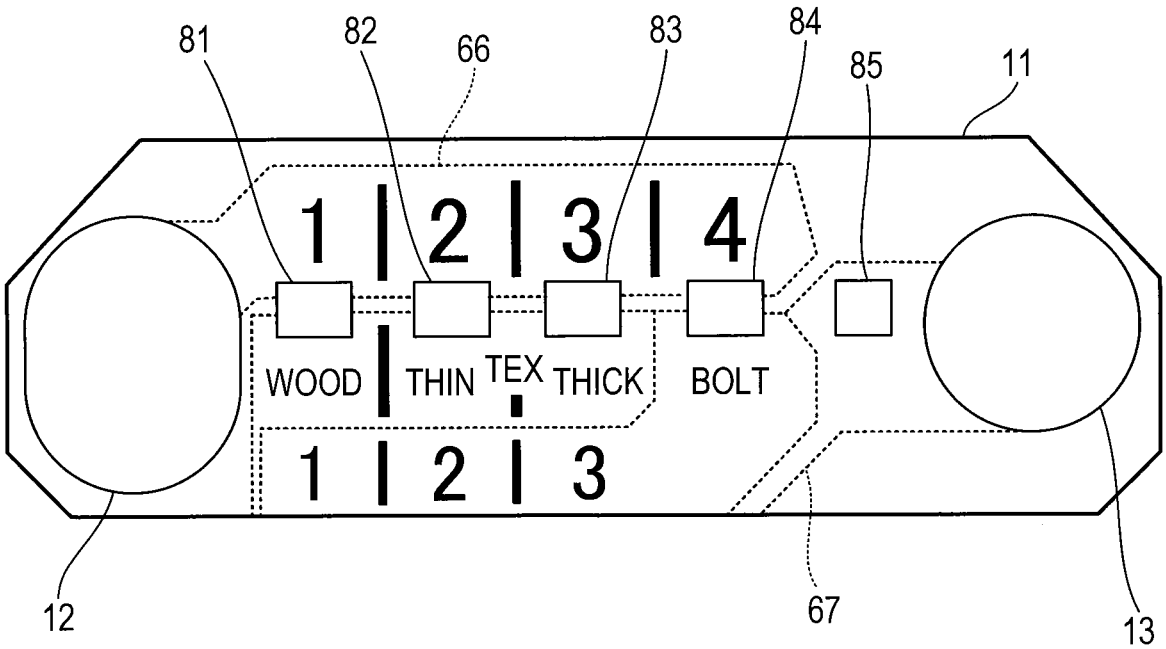
FIG. 5 is a plan view of an operation panel.

As shown in FIG. 5, the operation panel 11 includes the impact button 12, the special button 13, an impact mode indicator 66, and a special mode indicator 67, in addition to the first to fifth LEDs 81 to 85.

The impact mode indicator 66 and the special mode indicator 67 turn on or off each of the first to fifth LEDs 81 to 85 based on a command from the indicator circuit 54.

When the driver 1 is set to the Max mode, the first to fourth LEDs 81 to 84 are turned on. When the driver 1 is set to the Hard mode, the first to third LEDs 81 to 83 are turned on. When the driver 1 is set to the Medium mode, the first and second LEDs 81 and 82 are turned on. When the driver 1 is set to the Soft mode, the first LED 81 is turned on.

When the driver 1 is set to the Wood mode, the first and fifth LEDs 81 and 85 are turned on. When the driver 1 is set to the First Tex mode, the second and fifth LEDs 82 and 85 are turned on. When the driver 1 is set to the Second Tex mode, the third and fifth LEDs 83 and 85 are turned on.

When the driver 1 is set to the First Bolt mode, the first, fourth, and fifth LEDs 81, 84, and 85 are turned on. When the driver 1 is set to the Second Bolt mode, the second, fourth, and fifth LEDs 82, 84, and 85 are turned on. When the driver 1 is set to the Third Bolt mode, the third, fourth, and fifth LEDs 83, 84, and 85 are turned on.

Each of the four impact modes (Max mode, Hard mode, Medium mode, and Soft mode) has a first set of basic duty ratios and a second set of basic duty ratios. Each of the first set of basic duty ratios and the second set of basic duty ratios is assigned to a base for a duty ratio (drive duty ratio) of the PWM signal.

In the present embodiment, the trigger pulling amount varies from "1" (first level) to "10" (tenth level). The first level corresponds to a range including a minimum trigger pulling amount. The tenth level corresponds to a range including a maximum trigger pulling amount. The level sequentially increases from the first to tenth level in response to the trigger pulling amount increasing.

As later described with reference to FIG. 6, for example, ten levels are associated with the respective basic duty ratios included in the first and second sets of basic duty ratios. In each of the four impact modes, a basic duty ratio corresponding to the tenth level is the largest of the first set of basic duty ratios, and a basic duty ratio corresponding to the tenth level is the largest of the second set of basic duty ratios. When the motor 21 is driven based on the basic duty ratio corresponding to the tenth level, the motor 21 rotates at a maximum speed.

The basic duty ratio associated with the tenth level of the first set of basic duty ratios in each of the four impact modes decrease in an order of the Max mode, the Hard mode, the Medium mode, and the Soft mode. The basic duty ratio associated with the tenth level of the second set of basic duty ratios in each of the four impact modes decrease in an order of the Max mode, the Hard mode, the Medium mode, and the Soft mode.

In any of the four impact modes, the first and second basic duty ratios corresponding to the first level are minimum values near zero (0). In any of the four impact modes, as the trigger pulling amount increases from the first level to the tenth level, the corresponding basic duty ratios gradually increase.

Accordingly, in the four impact modes, the trigger pulling amount of the first level or more is an effective operation range, and the trigger pulling amount from the first level to the tenth level is a control range. The effective operation range corresponds to a range of the trigger pulling amount where the motor 21 is drivable. The control range corresponds to a range where the motor speed is adjustable.

Therefore, when the trigger 7 is pulled in any of the four impact modes, the motor speed gradually increases. In this case, the motor speed in a no-load state reaches a constant speed that corresponds to the trigger pulling amount.

Then, when a load is applied to the motor 21 due to tightening of a screw or the like, the motor speed decreases in accordance with the load. When hammering occurs after the motor speed decreases in accordance with the load, the load applied to the motor 21 temporarily decreases. Thus, the motor speed fluctuates.

The effective operation range and the control range may be set appropriately with an entire operation area of the trigger 7.

The First Tex mode and the Second Tex mode are settings for tightening a Tex screw. The Tex screw has a leading end with a drill blade. The Tex screw is tightened to a workpiece while opening a screw-hole in the workpiece with the drill blade.

In the Second Tex mode, the control circuit 56 drives the motor 21 by the PWM signals based on the basic duty ratio corresponding to the trigger pulling amount in a first driving term, as in a case of the four impact modes. The first driving term is a time period from when the motor 21 is started until a first impact is detected. The first set of basic duty ratios in the Second Tex mode are consistent with the first set of basic duty ratios in the Max mode. The second set of basic duty ratios in the Second Tex mode are consistent with the second set of basic duty ratios in the Max mode.

In the Second Tex mode, when a specified number of impacts occur, the control circuit 56 determines that a screw-hole is formed in the workpiece. In this case, the control circuit 56 reduces the duty ratio of the PWM signal to decrease the motor speed.

This allows the motor 21 to rotate at a high speed from when the motor 21 is started until a screw-hole is formed in the workpiece. The motor 21, after a screw-hole is formed in the workpiece, can reduce the motor speed. Therefore, the user can stably perform screw tightening.

Either of the First Tex mode or the Second Tex mode may be selectively used depending on a thickness of the workpiece.

In the First Tex mode, the control circuit 56 drives the motor 1 by the PWM signal based on the first or second basic duty ratio corresponding to the trigger pulling amount in the first driving term, as in the case of the four impact modes. However, in the First Tex mode, the basic duty ratio corresponding to the trigger pulling amount from among the first set of basic duty ratios is slightly smaller than the basic duty ratio corresponding to the same trigger pulling amount from among the first set of basic duty ratios in the Hard mode. The basic duty ratio corresponding to the trigger pulling amount from among the second set of basic duty ratios is slightly smaller than the basic duty ratio corresponding to the same trigger pulling amount from among the second set of basic duty ratios in the Hard mode. In other words, the motor speed in the First Tex mode is slightly smaller than the motor speed in the Hard mode. When the specified number of impacts occur, the control circuit 56 stops the motor 21.

In the Wood mode, when the trigger 7 is pulled, the control circuit 56 sets the first or second basic duty ratio in accordance with the trigger pulling amount. The basic duty ratio corresponding to the trigger pulling amount from among the first set of basic duty ratios in the Wood mode is smaller than the basic duty ratio corresponding to the same trigger pulling amount from among the first set of basic duty ratios in the Max mode. The basic duty ratio corresponding to the trigger pulling amount from among the second set of basic duty ratios in the Wood mode is smaller than the basic duty ratio corresponding to the same trigger pulling amount from among the second set of basic duty ratios in the Max mode.

Then, when the specified number of impacts occur after the motor 21 is started, the control circuit 56 gradually increases the drive duty ratio. This is because, when a screw is fastened to the wood, the screw may not be cut into the wood immediately after the motor 21 is driven. When the screw is not cut into the wood, it is necessary to slowly rotate the screw, immediately after the motor 21 is driven, to have the screw cut into the wood.

In the Wood mode, the control circuit 56, after the motor 21 is started, drives the motor 21 at a low rotational speed. The control circuit 56, when the specified number of impacts occur after the motor 21 is driven at a low rotational speed, gradually increases the motor speed, assuming that the screw is cut into the wood. As a result, the user can efficiently tighten the screw to the wood in a short time.

The First Bolt mode, the Second Bolt mode, and the Third Bolt mode are settings for tightening or loosening a bolt or a nut. Hereinafter, the First Bolt mode, the Second Bolt mode, and the Third Bolt mode are collectively called Bolt mode.

When rotating the motor 21 to tighten or loosen a bolt, a tool bit is fitted over a head of the bolt. Thus, it is unlikely that the tool bit slips off from the bolt.

Therefore, in the Bolt mode, the trigger pulling amount corresponding to the maximum basic duty ratio is smaller than the trigger pulling amount corresponding to the maximum basic duty ratio in the four impact modes.

In other words, in the Bolt mode, the basic duty ratio is largest when the trigger pulling amount is the fourth level or more.

Also, in the Bolt mode, the basic duty ratio corresponding to each of the trigger pulling amounts of the fourth level or more from among the first set of basic duty ratios is set to the same or almost the same value as the largest value of the first set of basic duty ratios in the Max mode (that is, basic duty ratio corresponding to the tenth level). The reason is that a bolt can be quickly tightened or loosened. The same applies to the basic duty ratio corresponding to each of the trigger pulling amounts of the fourth level or more from among the second set of basic duty ratios in the Bolt mode.

Therefore, in the Bolt mode, the motor 21 rotates at the fastest speed even if the trigger 7 is pulled a little, as compared to a case in the Max mode. This allows the user to efficiently tighten or loosen a bolt in a short time.

Also, the user, in the Bolt mode, can rotate the motor 21 at a high speed without pulling the trigger 7 to near the maximum trigger pulling amount. Thus, finger fatigue of the user due to operation of the trigger 7 upon tightening or loosening a bolt is reduced. This can inhibit a situation where the user cannot continue the operation for a long time.

Also, in the Bolt mode, the motor 21 is reversely rotated to loosen a bolt or nut. In this case, when the motor 21 is started, the impact occurs right away due to a load applied from the bolt or the nut.

Then, when the bolt or nut is loosened by the impact, the load applied to the motor 21 is reduced. This increases the motor speed.

Therefore, the control characteristics corresponding to the Bolt mode are set as follows. At the time of reverse rotation of the motor 21, when the impact is no longer detected for a specified time period after detection of the impact, the motor 21 is stopped or the motor speed is reduced.

Thus, when loosening a bolt or a nut, the motor 21 is inhibited from rotating more than necessary. This inhibits a bolt or a nut from falling off from the tool bit.

In the First Bolt mode, the control circuit 56 rotates the motor 21 in the forward direction as follows. The control circuit 56 drives the motor 21 at the motor speed of 2500 rpm (revolution per minute) from when the motor 21 is started until the impact occurs. Then, when the specified number of impacts occur, the control circuit 56 stops the motor 21.

In the First Bolt mode, the control circuit 56 rotates the motor 21 in the reverse direction. The control circuit 56 first drives the motor 21 at 2500 rpm. Then, after the impact is detected and when the impact is no longer detected for a specified time period, the control circuit 56 rotates the motor 21 twice and stops the motor 21.

In the Second Bolt mode, the control circuit 56 rotates the motor 21 in the forward direction as follows. The control circuit 56 drives the motor 21 as in the Max mode from when the motor 21 is started until the impact occurs. Then, when the specified number of impacts occur and then the impact further continues for 0.3 seconds, the control circuit 56 stops the motor 21.

In the Second Bolt mode, the control circuit 56 rotates the motor 21 in the reverse direction as follows. The control circuit 56 first drives the motor 21 as in the Max mode. Then, after the impact is detected and when the impact is no longer detected for a specified time, the control circuit 56 rotates the motor 21 twice and then stops the motor 21.

In the Third Bolt mode, the control circuit 56 rotates the motor 21 in the forward direction as follows. The control circuit 56 drives the motor 21 as in the Max mode from when the motor 21 is started until the impact occurs. Then, when the specified number of impacts occur and then the impact further continues for one seconds, the control circuit 56 stops the motor 21.

In the Third Bolt mode, the control circuit 56 rotates the motor 21 in the reverse rotation as follows. The control circuit 56 first drives the motor 21 as in the Max mode. Then, after the impact is detected and when the impact is no longer detected for a specified time period, the control circuit 56 rapidly reduces the motor speed to 250 rpm.

In the ROM 56*b*, a setting table 90 shown in FIG. 6 is stored. The setting table 90 includes a set of levels of the trigger pulling amount. The setting table 90 further includes a first set of target rotational speeds, a second set of target rotational speeds, a first set of basic duty ratios, and a second set of basic duty ratios, associated with each of the four impact modes.

The first set of target rotational speeds, the first set of basic duty ratios, the second set of target rotational speeds, and the second set of basic duty ratios are associated with the ten levels (first to tenth levels) of the trigger pulling amount. In other words, in the present embodiment, the first set of target rotational speeds include, for example, ten target rotational speeds. The first set of basic duty ratios include, for example, ten basic duty ratios. The second set of target rotational speeds, for example, includes ten target rotational speeds. The second set of basic duty ratios include, for example, ten basic duty ratios.

The first set of target rotational speeds and the first set of basic duty ratios are, for example, referred in the first driving term. The second set of target rotational speeds and the second set of basic duty ratios are, for example, referred in a second driving term. The second driving term is, for example, a specified time period after initial impact timing (for example, until the motor 21 is stopped). The initial impact timing corresponds to a timing when the impact is first detected after the motor 21 is started.

Any two of the first to tenth levels correspond to an example of a first level and a second level of the present disclosure.

Although not shown in FIG. 6, the setting table 90 also includes the first set of target rotational speeds, the first set of basic duty ratios, the second set of target rotational speeds, and the second set of basic duty ratios for each of the Wood mode, the First Tex mode, the Second Tex mode, the First Bolt mode, the Second Bolt mode, and the Third Bolt mode, as in the four impact modes.

Figure 7:
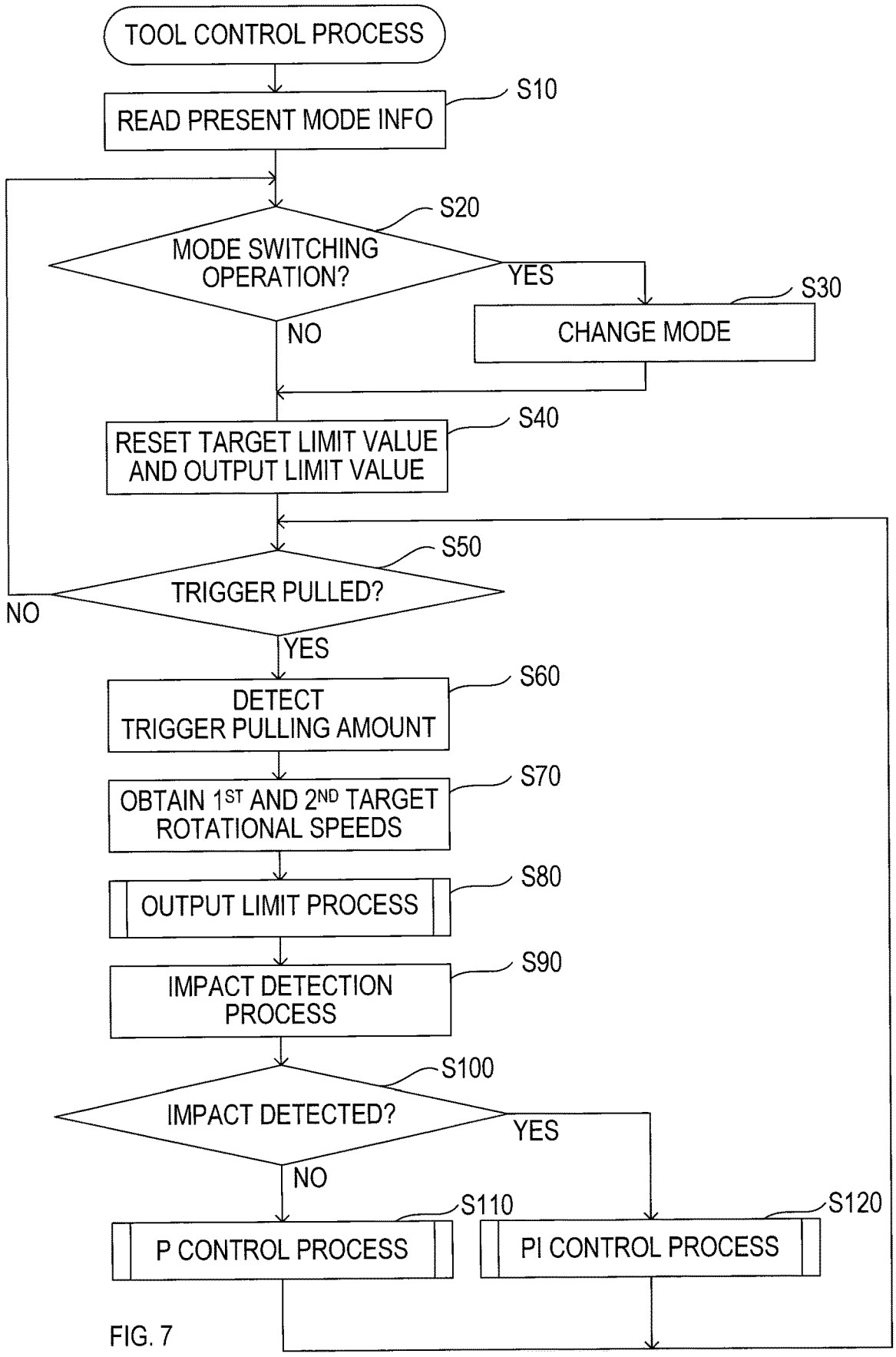
FIG. 7 is a flowchart showing a tool control process.

Hereinafter, a tool control process executed by the CPU 56*a* will be described with reference to FIG. 7. The tool control process is started when the control circuit 56 receives the power-supply voltage Vcc and is started. The tool control process corresponds to a motor control process of the present disclosure.

The CPU 56*a* when starting the tool control process, reads present mode information from the ROM 56*b* in S10. The present mode information indicates the operation mode presently set.

The CPU 56*a* determines in S20 whether a mode switching operation is performed. The mode switching operation corresponds to operation of one of the mode-changing switch 9, the impact button 12, or the special button 13.

When the mode switching operation is not performed, the CPU 56*a* proceeds to S40. When the mode switching operation is performed (for example, when the mode-changing switch 9 is operated), the CPU 56*a* proceeds to S30. In S30, the CPU 56*a* changes the operation mode based on the presently set operation mode and the mode switching operation detected in S20. In S30, information indicating the operation mode after the change is stored as present mode information in the ROM 56*b*. After the process in S30, the CPU 56*a* proceeds to S40.

In S40, the CPU 56*a* resets (initializes) a target limit value LS and an output limit value LD. Specifically, the CPU 56*a* resets the target limit value LS and the output limit value LD respectively stored in a first memory area and a second memory area (for example, to zero (0)). The first memory area and the second memory area may be provided, for example, in the RAM 56*c*.

In S50, the CPU 56*a* determines whether the trigger 7 is pulled based on an input signal from the main switch 61. When the trigger 7 is not pulled, the CPU 56*a* proceeds to S20.

When the trigger 7 is pulled, the CPU 56*a* detects the trigger pulling amount based on the input signal from the operated amount sensor 62 in S60. The CPU 56*a* obtains the first target rotational speed from the setting table 90 in S70. The first target rotational speed corresponds to the present operation mode and the trigger pulling amount. Specifically, the CPU 56*a* determines an actual level (any of first to tenth levels) of the trigger pulling amount. The actual level corresponds to the detected trigger pulling amount. The CPU 56*a* obtains the target rotational speed corresponding to the actual level from among the first set of target rotational speeds as the first target rotational speed. The first set of target rotational speeds correspond to the present operation mode. In S70, the CPU 56*a* further obtains the second target rotational speed from the setting table 90 in the same manner as for the first target rotational speed. The second target rotational speeds corresponds to the present operation mode and the trigger pulling amount (specifically, the actual level).

In S80, the CPU 56*a* executes a later described output limit process.

In S90, the CPU 56*a* executes an impact detection process. The impact detection process is a process to detect whether the impact has occurred. The impact detection process may be executed as follows, for example. The CPU 56*a* first determines whether variation in the motor speed is equal to or greater than a preset first determination value. The variation in the motor speed may be, for example, calculated by the speed calculator 74 within a preset determination time. In the present embodiment, the determination time is set to 50 [ms], for example, and the first determination value is set to 100 rpm, for example.

When the variation in the motor speed is smaller than the first determination value, the CPU 56*a* terminates the impact detection process.

On the other hand, if the variation in the motor speed is equal to or greater than the first determination value, the CPU 56*a* increments a value of an impact counter provided in the RAM 56*c* (for example, by one). When the trigger 7 is released, the value of the impact counter is reset (for example, set to zero (0)).

The CPU 56*a* further determines whether the value of the impact counter is equal to or greater than a preset second determination value. When the value of the impact counter is smaller than the second determination value, the CPU 56*a* terminates the impact detection process.

When the value of the impact counter is equal to or greater than the second determination value, the CPU 56*a* sets an impact detection flag provided in the RAM 56*c*. When setting the impact detection flag, the CPU 56*a* terminates the impact detection process. The impact detection flag may be cleared at any timing. The impact detection flag may be cleared when the trigger 7 is released, for example.

When the impact detection process in S90 is terminated, the CPU 56*a* determines in S100 whether the impact is detected. Specifically, the CPU 56*a* determines whether the impact detection flag is set. The CPU 56*a*, when the impact detection flag is set, determines that the impact is detected. The CPU 56*a*, when the impact detection flag is cleared, determines that the impact is not detected.

When it is determined in S100 that the impact is not detected, the CPU 56*a* executes a proportional (P) control process in S110. After the P control process is executed, the CPU 56*a* proceeds to S50. On the other hand, when it is determined in S100 that the impact is detected, the CPU 56*a* executes a proportional-integral (PI) control process in S120. After the PI control process is executed, the CPU 56*a* proceeds to S50.

The output limit process in S80 will be specifically described with reference to FIG. 8.

The CPU 56*a*, when starting the output limit process, calculates a present current value in S210. Specifically, the CPU 56*a* obtains the current detection signal from the current detection circuit 52. The CPU 56*a* calculates the current value based on the current detection signal. The current value indicates a load applied to the motor. In other words, the current value corresponds to a magnitude of the load applied to the motor 21.

The CPU 56*a* determines in S220 whether the current value calculated in S210 is equal to or greater than a preset first threshold. The CPU 56*a*, when the current value is smaller than the first threshold, terminates the output limit process.

The CPU 56*a*, when the current value is equal to or greater than the first threshold, moves to S230. In S230, the CPU 56*a* calculates a current value error CD. The current value error CD corresponds to a difference between the present current value and the first threshold. Specifically, the CPU 56*a* calculates the current value error CD by subtracting the first threshold from the current value calculated in S210, and stores the calculated current value error CD in a third memory area. The third memory area may be provided, for example, in the RAM 56*c*.

The CPU 56*a* increases the target limit value LS in S240. Specifically, the CPU 56*a* calculates the new target limit value LS by adding a decremental speed IS to the value presently stored in the first memory area (i.e., target limit value LS). The decremental speed IS may be, for example, set in advance. The CPU 56*a* stores the calculated new target limit value LS in the first memory area. The CPU 56*a* may update the target limit value LS presently stored in the first memory area to the new target limit value LS.

The CPU 56*a* increases the output limit value LD in S250. Specifically, the CPU 56*a* calculates the new output limit value LD by adding a decremental duty ratio ID to the value presently stored in the second memory area (i.e., output limit value LD). The decremental duty ratio ID may be, for example, set in advance. The CPU 56*a* stores the new output limit value LD in the second memory area. The CPU 56*a* may update the output limit value LD presently stored in the second memory area to the new output limit value LD. The CPU 56*a*, after the step of S250, terminates the output limit process.

Figure 9:
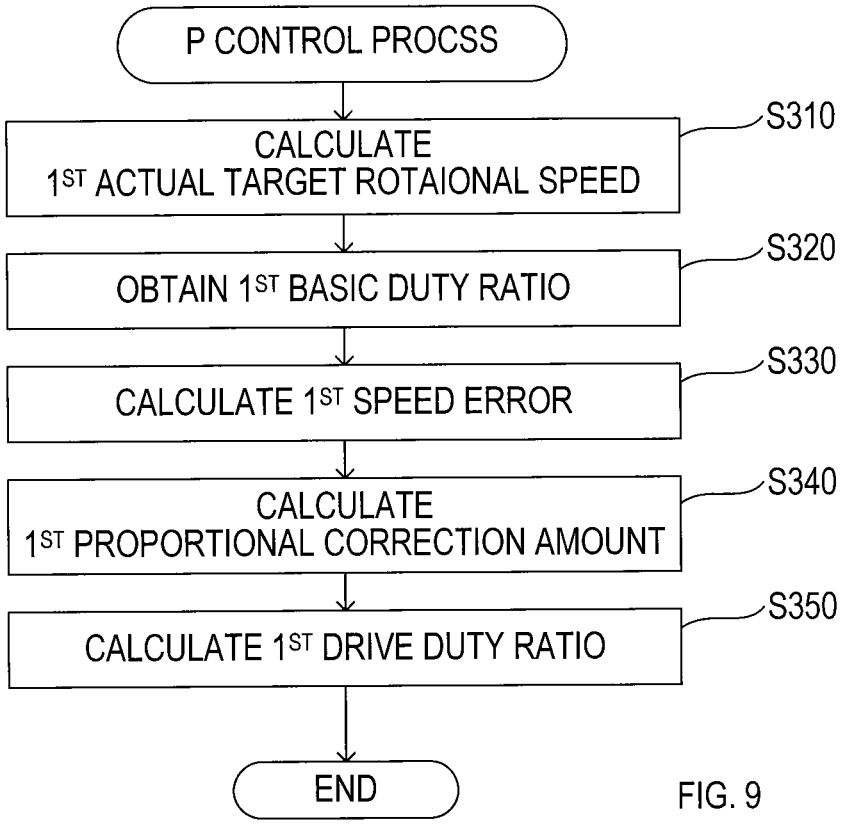
FIG. 9 is a flowchart showing a P control process.

The P control process in S110 will be specifically described with reference to FIG. 9.

The CPU 56*a*, when starting the P control process, calculates a first actual target rotational speed TG1 in S310. Specifically, the CPU 56*a* calculates the first actual target rotational speed TG1 by subtracting the value stored in the first memory area (i.e., target limit value LS) from the first target rotational speed obtained in S70. The CPU 56*a* stores the calculated first actual target rotational speed TG1 in a fourth memory area. The fourth memory area may be provided, for example, in the RAM 56*c*.

The CPU 56*a* obtains the first basic duty ratio BD1 from the setting table 90 in S320. Specifically, the CPU 56*a* obtains the present operation mode, and the basic duty ratio corresponding to the trigger pulling amount (specifically, corresponding to the actual level) detected in S60 from among the first set of basic duty ratios corresponding to the present operation mode, as the first basic duty ratio BD1. The CPU 56*a* stores a value indicating the obtained first basic duty ratio BD1 in a fifth memory area. The fifth memory area may be provided, for example, in the RAM 56*c*.

The CPU 56*a* calculates a first speed error Dif1 in S330. The first speed error Dif1 is a value obtained by subtracting the present motor speed (hereinafter, "actual rotational speed") from the value stored in the fourth memory area (first actual target rotational speed TG1). The CPU 56*a* stores the calculated first speed error Dif1 in a sixth memory area provided in the RAM 56*c*.

The CPU 56*a* calculates a first proportional correction amount OP1 (or first proportional duty ratio) in S340. The first proportional correction amount OP1 is a value obtained by multiplying the first speed error Dif1 stored in the sixth memory area and the proportional gain GP. The CPU 56*a* stores the calculated first proportional correction amount OP1 in a seventh memory area. The seventh memory area may be provided, for example, in the RAM 56*c*. The proportional gain GP may be, for example, set in advance. In the present embodiment, the proportional gain GP may be set, for example, to 0.01.

The CPU 56*a* calculates the first drive duty ratio DD1 in S350, and terminates the P control process. Specifically, in S350, the CPU 56*a* adds the first basic duty ratio BD1 stored in the fifth memory area and the first proportional correction amount OP1 stored in the seventh memory area. A value obtained by adding the first basic duty ratio BD1 and the first proportional correction amount OP1 is referred to as a first unlimited drive duty ratio.

The CPU 56*a* further subtracts the output limit value LD stored in the second memory area from the first unlimited drive duty ratio. A value obtained by the subtraction is the first drive duty ratio DD1.

After the tool control process is started, the output limit value LD is maintained at the initial value (e.g., zero (0)) until it is determined in S220 that the current value is equal to or greater than the first threshold.

After the tool control process is started, when it is first determined in S220 that the current value is equal to or greater than the first threshold, a step of S250 is executed for the first time. The first execution of S250 increases the output limit value LD by the decremental duty ratio ID from the initial value. In this case, the decremental duty ratio ID corresponds to an example of the first magnitude of the present disclosure. In this case, the output of the motor 21 corresponding to the decremental duty ratio ID corresponds to an example of the first magnitude of the present disclosure. Also, the first drive duty ratio DD1 in this case corresponds to a value obtained by subtracting at least the decremental duty ratio ID from the first unlimited drive duty ratio. The first drive duty ratio DD1 or the output of the motor 21 based on the first drive duty ratio DD1 corresponds to an example of a first limited output of the present disclosure.

After the tool control process is started, when it is determined for the second time in S220 that the current value is equal to or greater than the first threshold, the step of S250 is executed for the second time. The second execution of S250 further increases the output limit value LD by the decremental duty ratio ID from the present value. In this case, an increase of the output limit value LD from the initial value corresponds to an example of a second magnitude of the present disclosure. In this case, the output of the motor 21 corresponding to the increase corresponds to an example of the second magnitude of the present disclosure. Also, the first drive duty ratio DD1 or the output of the motor 21 based on the first drive duty ratio DD1 corresponds to an example of a second limited output of the present disclosure.

After the tool control process is started, when it is determined for the third time in S220 that the current value is equal to or greater than the first threshold, the step of S250 is executed for the third time. The third execution of S250 further increases the output limit value LD by the decremental duty ratio ID from the present value. In this case, an increase of the output limit value LD from the initial value corresponds to an example of a third magnitude of the present disclosure. In this case, the output of the motor 21 corresponding to the increase corresponds to an example of the third magnitude of the present disclosure. Also, the first drive duty ratio DD1 or the output of the motor 21 based on the first drive duty ratio DD1 corresponds to an example of a third limited output of the present disclosure.

As above, after the tool control process is started, each time it is determined in S220 that the current value is equal to or greater than the first threshold, the output limit value LD is increased by the step of S250. Each time the step of S250 is executed, the first drive duty ratio DD1 is gradually reduced from the first unlimited drive duty ratio. In other words, after the tool control process is started, when it is determined for the Mth time in S220 that the current value is equal to or greater than the first threshold, the step of S250 is executed for the Mth time. "M" is a natural number. The output limit value LD calculated in the Mth execution of the step of S250 is referred to as an Mth output limit value LDN. When the step of S250 is executed for the Mth time, the first drive duty ratio DD1 is reduced to be smaller than the first unlimited drive duty ratio by the Mth output limit value LDN.

The CPU 56*a* stores the calculated first drive duty ratio DD1 in an eighth memory area in S350. The eighth memory area may be provided, for example, in the RAM 56*c*. The CPU 56*a* generates PWM signals based on the first drive duty ratio DD1. The motor drive control device 76 drives the drive circuit 51 (and the motor 21) in accordance with the PWM signals.

As above, the P control process does not include an integral control process (or integral action). In other words, the first drive duty ratio DD1 does not include a correction amount based on the cumulative value (integral value) of the first speed error Dif1. The first drive duty ratio DD1 may be calculated, for example, by subtracting the output limit value LD from a value obtained by adding only the first proportional correction amount OP1 to the first basic duty ratio BD1.

Figure 10:
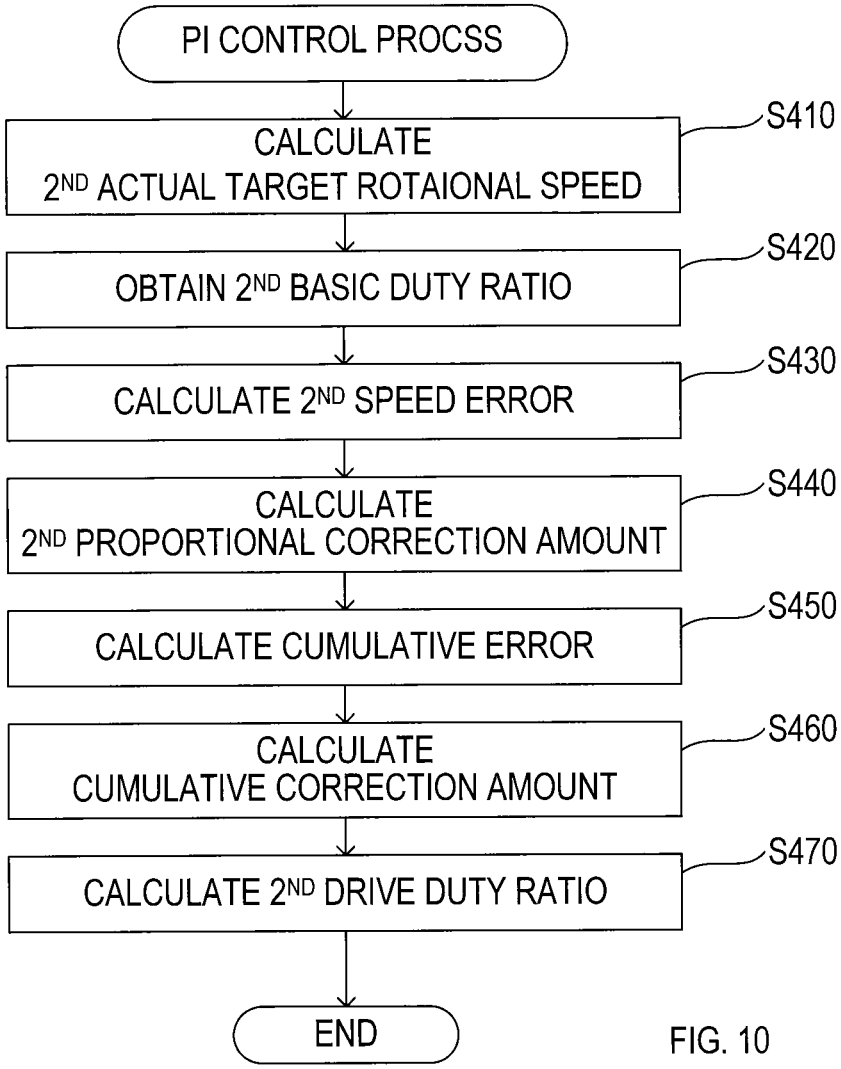
FIG. 10 is a flowchart showing a PI control process.

The PI control process in S120 will be described with reference to FIG. 10.

The CPU 56*a*, when starting the PI control process, calculates a second actual target rotational speed TG2 in S410. Specifically, the CPU 56*a* calculates the second actual target rotational speed TG2 by subtracting the value stored in the first memory area (target limit value LS) from the second target value obtained in S70. The CPU 56*a* stores the calculated second actual target rotational speed TG2 in a ninth memory area. The ninth memory area may be provided, for example, in the RAM 56*c*.

The CPU 56*a* obtains a second basic duty ratio BD2 from the setting table 90 in S420. Specifically, the CPU 56*a* obtains the basic duty ratio BD2, corresponding to the present operation mode and the trigger pulling amount (specifically, the actual level) detected in S60, from among the second set of basic duty ratios corresponding to the present operation mode, as the second basic duty ratio BD2. The CPU 56*a* stores a value corresponding to the obtained second basic duty ratio BD2, for example, in the fifth memory area.

The CPU 56*a* calculates a second speed error Dif2 in S430. The second speed error Dif2 is obtained by subtracting the actual rotational speed from the second actual target rotational speed TG2 stored in the ninth memory area. The CPU 56*a* stores the calculated second speed error Dif2, for example, in the sixth memory area.

The CPU 56*a* calculates a second proportional correction amount (or a second proportional duty ratio) OP2 in S440. The second proportional correction amount OP2 is obtained by multiplying the second speed error Dif2 stored in the sixth memory area and the proportional gain GP. The CPU 56*a* stores the calculated second proportional correction amount OP2, for example, in the seventh memory area. The proportional gain GP used in S440 may be the same as or a different from the proportional gain GP used in S340.

The CPU 56*a* calculates a cumulative error DI in S450. The cumulative error DI is obtained by adding the second speed error Dif2 stored in the sixth memory area to the present cumulative error DI stored in a tenth memory area. In other words, the cumulative error DI corresponds to a value obtained by cumulatively adding the second speed error Dif2. The second speed error Dif2 is calculated in S430 each time after the tool control process is started. The CPU 56*a* stores the calculated cumulative error DI in a tenth memory area. Specifically, the CPU 56*a* updates the previous value of the cumulative error DI stored in the tenth memory area to the newest value of the cumulative error DI calculated this time. The tenth memory area may be provided, for example, in the RAM 56*c*.

The CPU 56*a* calculates a cumulative correction amount OI in S460. The cumulative correction amount OI is obtained by multiplying the cumulative error DI stored in the tenth memory area and a preset cumulative gain GI. The CPU 56*a* stores the calculated cumulative correction amount OI in an eleventh memory area. The eleventh memory area may be provided, for example, in the RAM 56*c*.

The CPU 56*a* calculates a second drive duty ratio DD2 in S470, and terminates the PI control process. Specifically, in S470, the CPU 56*a* adds the second basic duty ratio BD2 stored in the fifth memory area, the second proportional correction amount OP2 stored in the seventh memory area, and the cumulative correction amount OI stored in the eleventh memory area. The second basic duty ratio BD2, the second proportional correction amount OP2, and the cumulative correction amount OI are added to obtain a second unlimited drive duty ratio.

The CPU 56*a* further subtracts the output limit value LD stored in the second memory area from the second unlimited drive duty ratio. The value obtained by the subtraction is the second drive duty ratio DD2. Subtracting the output limit value LD greater than the initial value from the second unlimited drive duty ratio corresponds to an example of limiting the output of the motor of the present disclosure.

The second drive duty ratio DD2 or the output of the motor based on the first drive duty ratio DD2, when the output limit value LD is the initial value, corresponds to an example of the basic output of the present disclosure.

The second duty ratio DD2, when the step of S250 is executed first time after the tool control process is started, corresponds to a value obtained by subtracting at least the decremental duty ratio ID from the second unlimited drive duty ratio. The second drive duty ratio DD2, or the output of the motor 21 based on the second drive duty ratio DD2 corresponds to an example of the first limited output of the present disclosure.

The second duty ratio DD2 or the output of the motor 21 based on the second drive duty ratio DD2, when it is determined in S220 that the current value is equal to or greater than the first threshold second time after the tool control process is started, corresponds to an example of a second limited output of the present disclosure.

The second duty ratio DD2 or the output of the motor 21 based on the second drive duty ratio DD2, when it is determined in S220 that the current value is equal to or greater than the first threshold third time after the tool control process is started, corresponds to an example of a third limited output of the present disclosure.

As above, each time the step of S250 is executed, the second drive duty ratio DD2 is reduced to be smaller than the second unlimited drive duty ratio. In other words, after the tool control process is started, when the step of S250 is executed N time, the second drive duty ratio DD2 is reduced to be smaller than the second unlimited drive duty ratio by the N output limit value LDN.

The CPU 56*a* stores the calculated second drive duty ratio DD2, for example, in the eighth memory area in S470.

Figure 11:
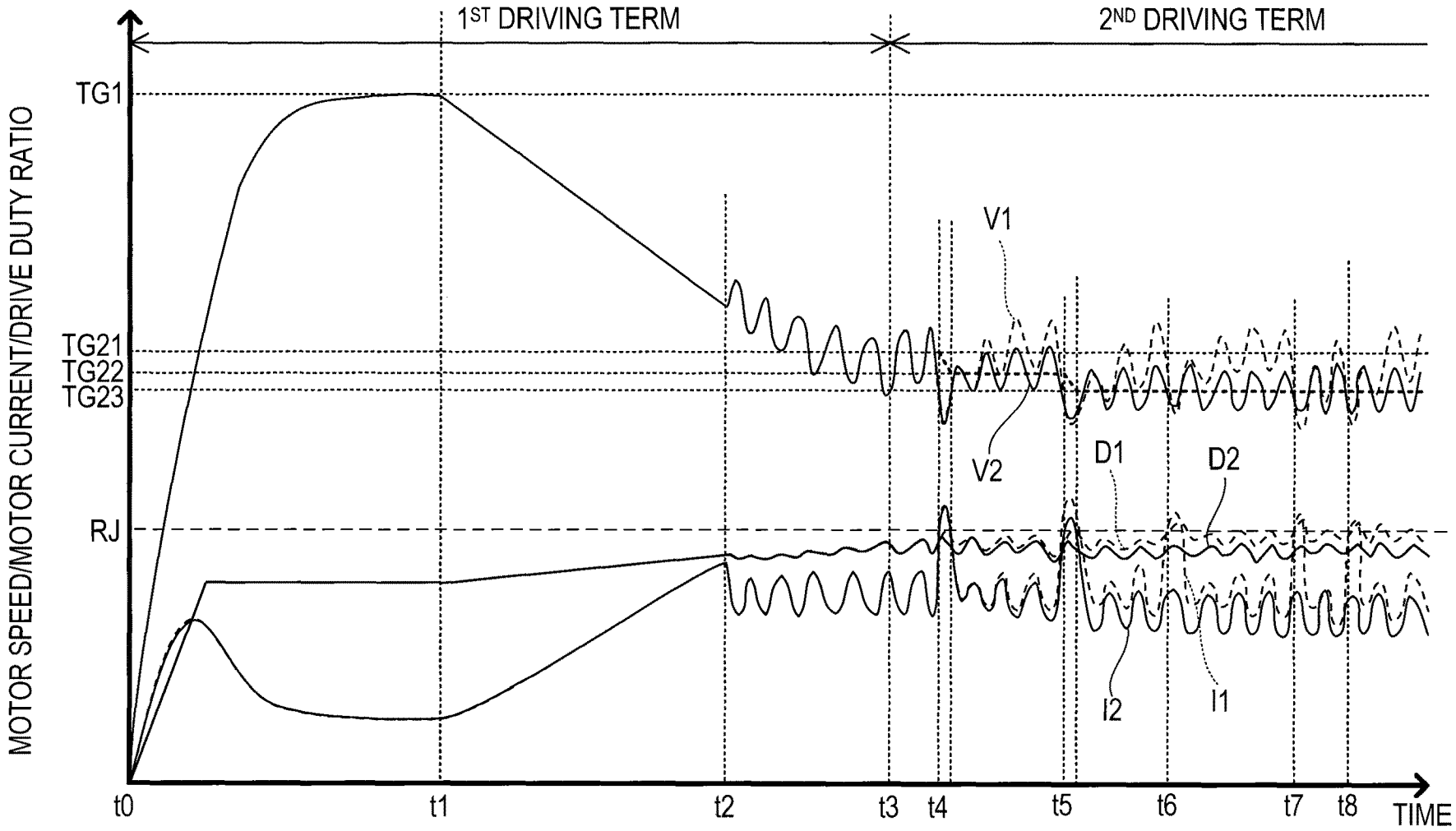
FIG. 11 is a first graph showing a time change of a motor speed, a motor current, and a drive duty ratio.

FIG. 11 shows an example of varying in an unlimited motor speed V1, a limited motor speed V2, an unlimited motor current I1, a limited motor current I2, an unlimited drive duty ratio D1, and a limited drive duty ratio D2, during a period from when the motor 21 is started until a certain time period elapses. FIG. 11 shows an example in which the unlimited motor current I1 and the limited motor current I2 exceed the first threshold RJ after the impact is detected. FIG. 11 includes the first driving term and the second driving term.

In FIG. 11, the motor 21 is started at time t0. The motor 21 starts to receive a load at time t1. The impacting is started at time t2. The impact is detected by the control circuit 56 (i.e., a timing when the impact detection flag is set) at time t3.

The unlimited motor speed V1 indicates an example of varying in the motor speed when the tool control process excluding the output limit process in S80 is executed.

The limited motor speed V2 indicates an example of varying in the motor speed when the tool control process (including the step of S80) is executed.

The unlimited motor current I1 indicates an example of the motor current when the tool control process excluding the output limit process in S80 is executed.

The limited motor current I2 indicates an example of varying in the motor current when the tool control process (including the step of S80) is executed.

The unlimited drive duty ratio D1 indicates an example of varying in the first drive duty ratio DD1 (in the first driving term) and the second drive duty ratio DD2 (in the second driving term) when the tool control process excluding the output limit process in S80 is executed.

The limited drive duty ratio D2 indicates an example of varying in the first drive duty ratio DD1 (in the first driving term) and the second drive duty ratio DD2 (in the second driving term) when the tool control process (including the step of S80) is executed.

In FIG. 11, the unlimited motor speed V1 reaches the first actual target rotational speed TG1 between time t0 and time t1. The unlimited motor speed V1 decreases linearly from time t1 to time t2. The unlimited motor speed V1 gradually decreases while fluctuating from time t2 to time t3. The unlimited motor speed V1 maintains near the second actual target rotational speed TG2 (first value TG21 to be later described in detail) while fluctuating after time t3.

The unlimited motor current I1 increases linearly from time t1 to time t2. The unlimited motor current I1 fluctuates after time t2. A value of the unlimited motor current I1 exceeds the first threshold RJ at time t4, time t5, time t6, time t7, and time t8.

The unlimited drive duty ratio D1 reaches the first basic duty ratio between time t0 and time t1. The unlimited drive duty ratio D1 increases linearly from time t1 to time t2. The unlimited drive duty ratio D1 maintains an approximately constant value while fluctuating after time t2.

When (i) an operation, for example, to use the driver 1 to tighten a bolt to an object is started and (ii) a specified time elapses, the bolt is tightened and no longer rotates. In this case, since the bolt does not rotate, the driver 1 is in a locked state. The locked state means a state in which the tool bit cannot be rotated. In the tool bit in the locked state, a large reaction force is transmitted to the hammer 28 by the hammer 28 impacting the anvil 29. At this time, the hammer 28 and the balls 24*b* may move too far rearward. When the balls 24*b* move too far, the balls 24*b* contact a rear end of the spindle groove 24*a*. When the hammer 28 and the balls 24*b* move too far, inertial force in a reverse direction is transmitted to the spindle 24 via the balls 24*b*. The reverse direction herein is a direction opposite the rotation direction of the spindle 24 rotated by the motor 21. The inertial force in the reverse direction acts on the spindle 24 as a rotation resistance.

A rotational speed (or rotational frequency) of the spindle 24 decreases when the inertial force in the reverse direction is transmitted to the spindle 24. The decrease in the rotational speed of the spindle 24 means a decrease in rotational speed of the planetary gear 26*a* and the sun gear 21*b*. The event as such can make the motor speed (i.e., rotational speed of a rotor of the motor 21) lower than the motor speed before the locked state of the driver 1 (see time t4, for example).

When the motor speed decreases as above, the motor current increases sharply by the PI control process. This makes the motor current exceed the first threshold RJ.

The limited motor speed V2 reaches the first actual target rotational speed TG1 between time t0 and time t1. The limited motor speed V2 decreases linearly from time t1 to time t2. The limited motor speed V2 gradually decreases while fluctuating from time t2 to time t3. The limited motor speed V2 maintains near the second actual target rotational speed TG2 while fluctuating after time t3. FIG. 11 shows an example of the second actual target rotational speed TG2 decreasing (i.e., being limited) in the order of the first value TG21, a second value TG22, and a third value TG23 after time t3.

Specifically, the limited motor speed V2 maintains near the first value TG21 while fluctuating from time t3 to time t4. The limited motor speed V2 maintains near the second value TG22 while fluctuating from time t4 to time t5. The second value TG22 is smaller than the first value TG21. The limited motor speed V2 maintains near the third value TG23 while fluctuating from time t5. The third value TG23 is smaller than the second value TG22.

The limited motor current I2 increases linearly from time t1 to time t2. The limited motor current I2 fluctuates after time t2. A value of the limited motor current I2 exceeds the first threshold RJ at time t4 and time t5. The value of the limited motor current I2, after exceeding the first threshold RJ at time t5, drops below the first threshold RJ. The limited motor current I2, after dropping below the first threshold RJ, maintains below the first threshold RJ.

The limited drive duty ratio D2 reaches the first basic duty ratio between time t0 and time t1. The limited drive duty ratio D2 increases linearly from time t1 to time t2. The limited drive duty ratio D2 maintains an approximately constant value while fluctuating after time t2. However, the limited drive duty ratio D2 is reduced to be smaller than the unlimited drive duty ratio D1 after time t4. The limited drive duty ratio D2 is reduced to be further smaller than the unlimited drive duty ratio D1 after time t5.

Figure 12:
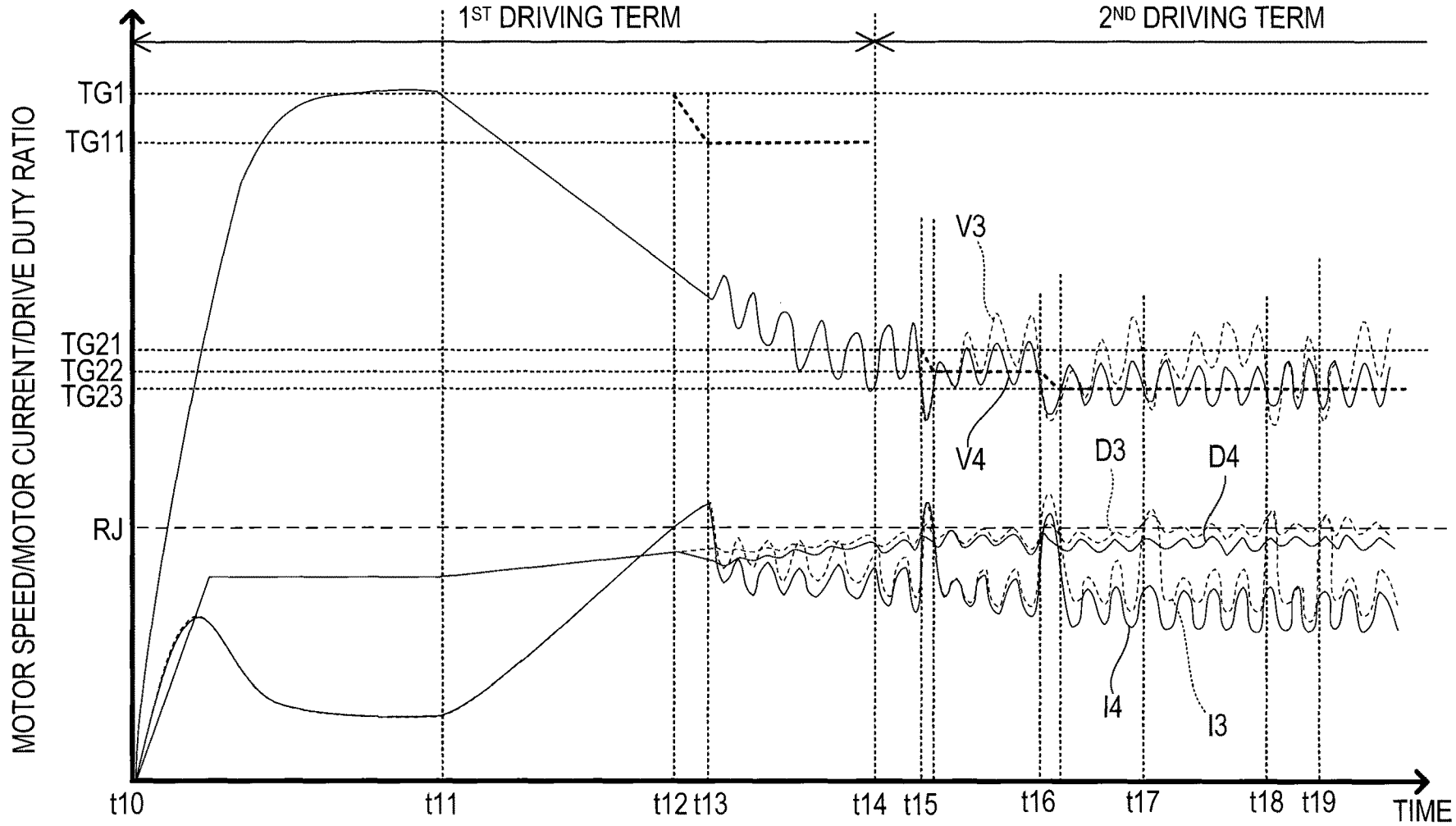
FIG. 12 is a second graph showing the time change of the motor speed, the motor current, and the drive duty ratio.

FIG. 12 shows an example of varying in the unlimited motor speed V3, the limited motor speed V4, the unlimited motor current I3, the limited motor current I4, the unlimited drive duty ratio D3 and the limited drive duty ratio D4 during a period from when the motor 21 is started until a certain time period elapses. FIG. 12 shows an example of the unlimited motor current I3 and the limited motor current I4 exceeding the first threshold RJ before the hammering is detected. FIG. 12 includes the first driving term and the second driving term.

In FIG. 12, the motor 21 is started at time t10. The motor 21 starts to receive a load at time tn. The unlimited motor current I3 and the limited motor current I4 exceed the first threshold RJ at time t12. The impacting is started at time t13. The impact is detected by the control circuit 56 (i.e., the timing when the impact detection flag is set) at time t14.

The unlimited motor speed V3 indicates an example of varying in the motor speed when the tool control process excluding the output limit process in S80 is executed.

The limited motor speed V4 indicates an example of varying in the motor speed when the tool control process (including the step of S80) is executed.

The unlimited motor current I3 indicates an example of varying in the motor current when the tool control process excluding the output limit process in S80 is executed.

The limited motor current I4 indicates an example of varying in the motor speed when the tool control process (including the step of S80) is executed.

The unlimited drive duty ratio D3 indicates an example of change in the first drive duty ratio DD1 (in the first driving term) and the second drive duty ratio DD2 (in the second driving term) when the tool control process excluding the output limit process in S80 is executed.

The limited drive duty ratio D4 indicates an example of varying in the first drive duty ratio DD1 (in the first driving term) and the second drive duty ratio DD2 (in the second driving term) when the tool control process (including the step of S80) is executed.

In FIG. 12, the unlimited motor speed V3 reaches the first actual target rotational speed TG1 between time t10 and time tn. The unlimited motor speed V3 decreases linearly from time t11 to time t13. The unlimited motor speed V3 gradually decreases while fluctuating from time t13 to time t14. The unlimited motor speed V3 maintains a value near the second actual target rotational speed TG2 (first value TG21 in detail) while fluctuating after time t14.

The unlimited motor current I3 increases linearly from time t11 to time t13. A value of the unlimited motor current I3 exceeds the first threshold RJ at time t12. The unlimited motor current I3 fluctuates after time t13. The value of the unlimited motor current I3 exceeds the first threshold RJ at time t15, time t16, time t17, time t18, and time t19.

The unlimited drive duty ratio D3 reaches the first basic duty ratio between time t10 and time tn. The unlimited drive duty ratio D3 increases linearly from time t11 to time t13. The unlimited drive duty ratio D3 maintains an approximately constant value while fluctuating after time t13.

The limited motor speed V4 reaches the first actual target rotational speed TG1 between time t10 and time tn. The limited motor speed V4 decreases linearly from time t11 to time t13. However, the limited motor current I4 exceeds the first threshold RJ at time t12. Thus, the limited motor speed V4 is controlled to be a first actual target rotational speed TG11 between time t13 and time t14. The first actual target rotational speed TG11 is smaller than the first actual target rotational speed TG1.

The limited motor speed V4 gradually decreases while fluctuating from time t13 to time t14. The limited motor speed V4 maintains a value near the second actual target rotational speed TG2 (first value TG21 in detail) while fluctuating from time t14 to time t15. The limited motor speed V4 maintains a value near the second actual target rotational speed TG2 (second value TG22 in detail) while fluctuating from time t15 to time t16. The limited motor speed V4 maintains a value near the second actual target rotational speed TG2 (third value TG23 in detail) while fluctuating after time t16.

The limited motor current I4 increases linearly from time t11 to time t12. The limited motor current I4 exceeds the first threshold RJ at time t12. The limited motor current I4 fluctuates after time t13. The limited motor current I4 is smaller than the unlimited motor current I3 from time t13 to time t14. A value of the limited motor current I4 exceeds the first threshold RJ at time t15 and time t16. The value of the limited motor current I4, after exceeding the first threshold RJ at time t16, falls below the first threshold RJ. The limited motor current I4, after falling below the first threshold RJ, maintains the value below the first threshold RJ.

The limited drive duty ratio D4 reaches the first basic duty ratio between time t10 and time tn. The limited drive duty ratio D4 increases linearly from time t11 to time t12. The limited drive duty ratio D4 gradually decreases from time t12 to time t13. The limited drive duty ratio D4 maintains approximately constant while fluctuating after time t13. However, the limited drive duty ratio D4 is reduced to be smaller than the unlimited drive duty ratio D3 between time t13 and time t14. The limited drive duty ratio D4 is reduced to be smaller than the unlimited drive duty ratio D3 after time t15. The limited drive duty ratio D4 is reduced to be further smaller than the unlimited drive duty ratio D3 after time t16.

In the driver 1 of the first embodiment configured as above, the control circuit 56 limits the output of the motor 21 when the current value of the motor 21 is equal to or greater than the first threshold.

Therefore, in the driver 1, continuous application of the large load due to the output of the motor 21 (for example, a load equal to or more than a magnitude corresponding to the current value of the first threshold) to the motor 21 is inhibited. This makes it difficult for a forward driving force and a reverse driving force to be applied to the sun gear 21*b* while the rotor of the motor 21 is driven in the forward direction. The forward driving force corresponds to a driving force in the forward direction applied by the rotor of the motor 21. The reverse driving force is a driving force in the reverse direction applied by the spindle 24. The reverse driving force is transmitted from the hammer 28 and the balls 24*b*. Thus, the sun gear 21*b* is less likely to be damaged. This also makes it difficult for the forward driving force and the reverse driving force to be applied to the planetary gear 26*a* that meshes with the sun gear 21*b*. Thus, the planetary gear 26*a* is less likely to be damaged. Similarly, the internal gear 27 that meshes with the planetary gear 26*a* is less likely damaged. In other words, damages to the driver 1 can be inhibited.

The control circuit 56 continues to limit the output of the motor 21 until the motor 21 stops when the current value of the motor 21 first reaches the first threshold. In other words, the output limit value LD continues to be greater than the initial value. This allows the driver 1 to inhibit the large load due to the output of the motor 21 to be continuously applied to the motor 21 at least from when the current value reaches the first threshold until the motor 21 stops. Damages to the driver 1 can be further inhibited.

The control circuit 56 controls the motor 21 so that the motor speed is consistent with the target rotational speed. The control circuit's limiting the output of the motor 21 includes reducing the target rotational speed. In the driver 1, the motor speed is reduced and the output of the motor 21 is limited also by reducing the target rotational speed.

The control circuit 56 controls the motor current based on the PWM signal. The control circuit 56 limits the output of the motor 21 by reducing the duty ratio of the PWM signal. In the driver 1, the output of the motor 21 can be limited by reducing the motor current.

The current value of the motor 21 being equal to or greater than the first threshold may indicate that the anvil 29 is locked (or fixed), that is, the anvil 29 is not rotated when the motor 21 is controlled to rotated by the control circuit 56. The control circuit 56 may determine whether the anvil 29 is locked while the motor 21 is controlled to be driven. The control circuit 56 may determine that the anvil 29 is locked when the current value of the motor 21 is equal to or greater than the first threshold. The control circuit 56 may limit the output of the motor 21 when determining that the anvil 29 is locked.

In the driver 1 configured as above, the output of the motor 21 is limited when the anvil 29 is locked. Thus, continuous application of the large load due to the output of the motor 21 to the motor 21 can be inhibited in a state in which the anvil 29 is locked. Thus, damages to the driver 1 can be inhibited.

The driver 1 corresponds to an example of an electric power tool of the present disclosure. The current value indicated by the current detection signal corresponds to an example of a first physical quantity of the present disclosure. The first threshold corresponds to an example of a threshold of the present disclosure. Determining in S220 that the current value is equal to or greater than the first threshold, and determining that the anvil 29 is locked correspond to an example of establishment of a preset condition of the present disclosure.

Second Embodiment

Figure 13:
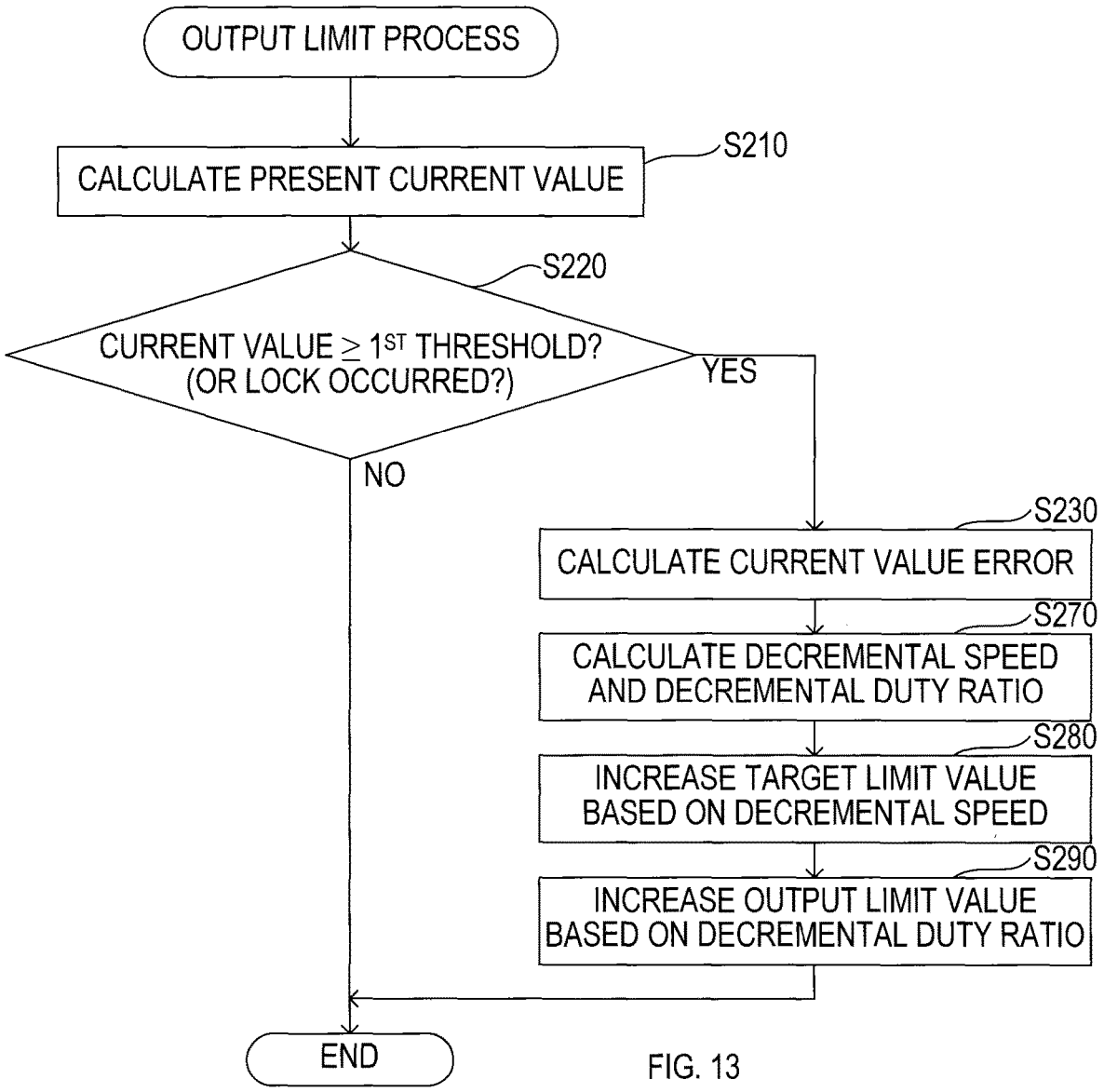
FIG. 13 is a flowchart showing the output limit process of the second embodiment.

Another example of the output limit process will be described with reference to FIG. 13. As shown in FIG. 13, the same reference numerals as those in the first embodiment shown in FIG. 8 are given to the steps common to those in the output limit process of the first embodiment. Hereinafter, differences from FIG. 8 will be described.

Figure 8:
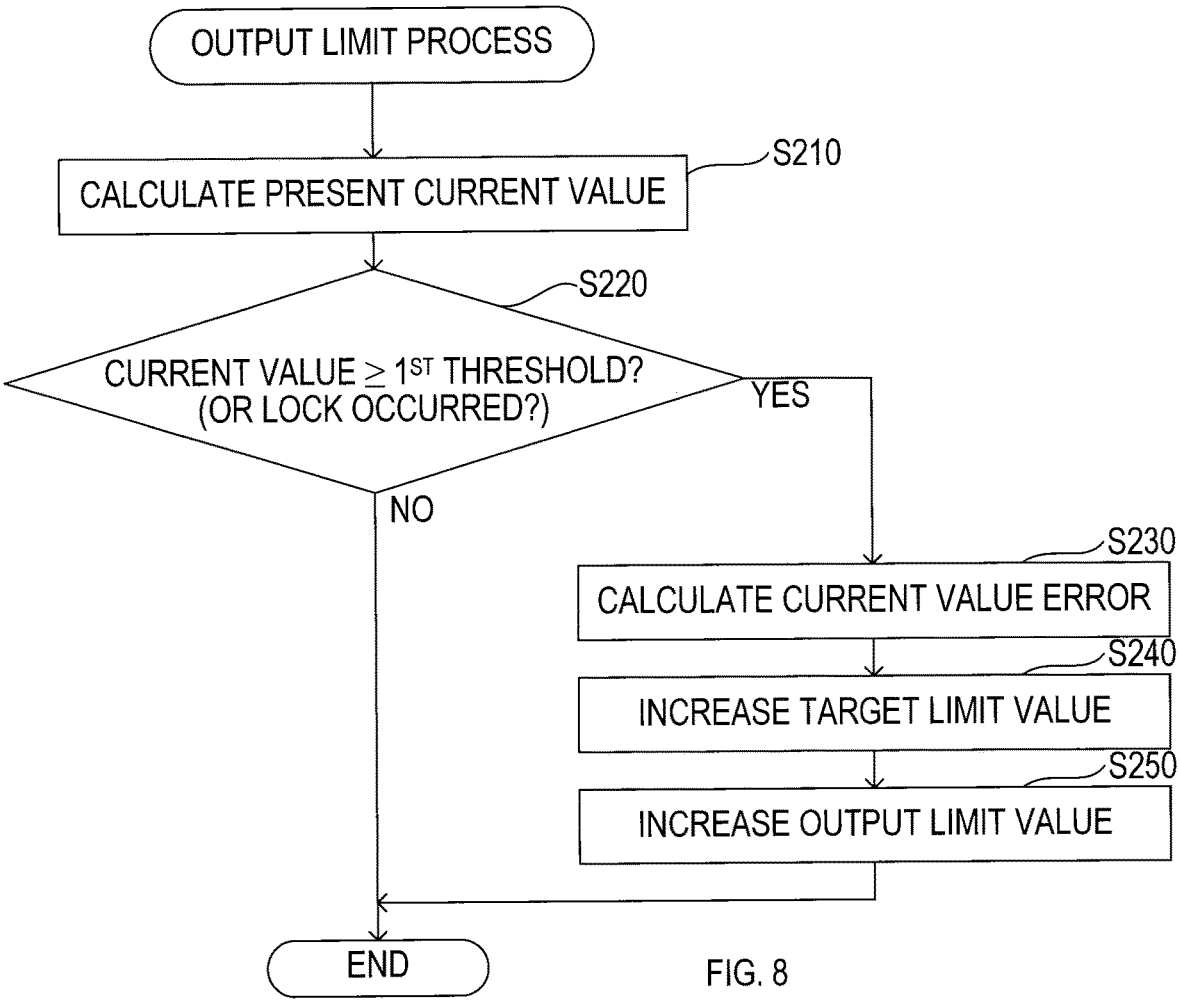
FIG. 8 is a flowchart showing an output limit process of the first embodiment.

As shown in FIG. 13, the output limit process of the second embodiment excludes the steps of S240 and S250 of the output limit process in FIG. 8, and includes additional steps of S270, S280, and S290.

In the second embodiment, the CPU 56*a* proceeds to S270 after the step of S230. In S270, the decremental speed IS and the decremental duty ratio ID are calculated. The decremental speed IS is calculated by multiplying a first gain ISG by the current value error CD. The CPU 56*a* stores the calculated decremental speed IS in a twelfth memory area. The twelfth memory area may be provided in the RAM 56*c*. The first gain ISG may be, for example, set in advance. The current value error CD is stored in the third memory area. The decremental duty ratio ID is calculated by multiplying a second gain IDG by the current value error CD. The CPU 56*a* stores the calculated decremental duty ratio ID in a thirteenth memory area. The thirteenth memory area may be provided in the RAM 56*c*. The second gain IDG may be, for example, set in advance.

In S280, the CPU 56*a* increases the target limit value LS based on the decremental speed IS. Specifically, the CPU 56*a* adds the decremental speed IS stored in the twelfth memory area to the target limit value LS stored in the first memory area. The target limit value LS increased as such is stored in the first memory area.

In S290, the CPU 56*a* increases the output limit value LD based on the decremental duty ratio ID. Specifically, the CPU 56*a* adds the decremental duty ratio ID stored in the thirteenth memory area to the output limit value LD stored in the second memory area. The output limit value LD increased as such is stored in the second memory area.

Third Embodiment

Figure 14:
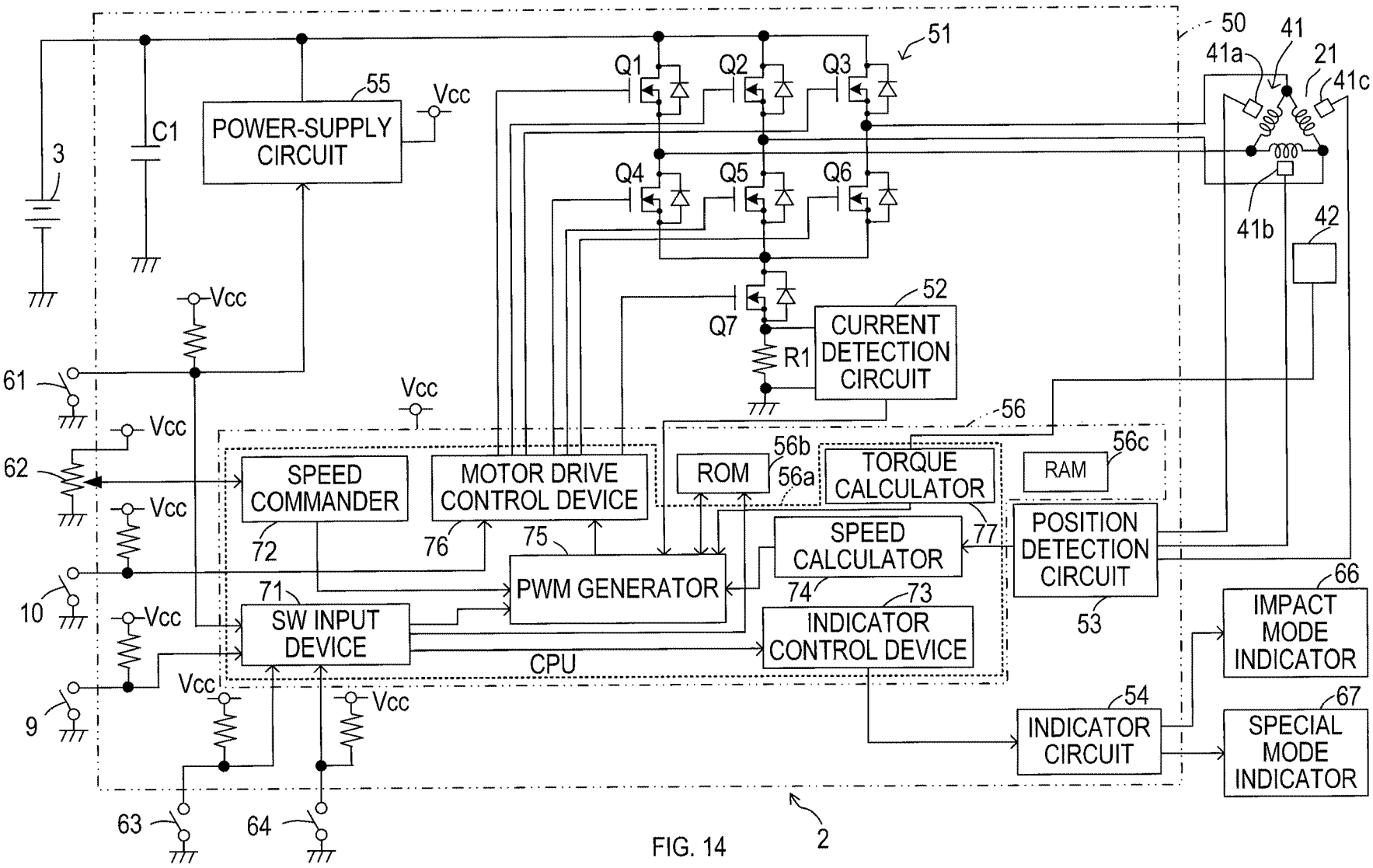
FIG. 14 is a block diagram showing an electrical configuration of the motor drive of a third and fourth embodiments.

The driver 1 of the third embodiment will be described with reference to FIGS. 14 and 15. In the following description, the same reference numerals as those in the first embodiment are given to the components common to those of the first embodiment. Hereinafter, differences from the first embodiment will be described.

The driver 1 of the third embodiment is different from the driver 1 of the first embodiment in the following points. The tool main body 2 includes a torque sensor 42, as shown in FIG. 14. The control circuit 56 includes a torque calculator 77. Further, as shown in FIG. 15, the output limit process is different from the output limit process of the first embodiment in its detail.

The torque sensor 42 detects a torque received by the output shaft 21*a* of the motor 21, and outputs a torque detection signal indicating the detected torque. The torque indicates the load applied to the motor 21. The torque sensor 42, for example, may detect a torque in a direction opposite the rotation direction of the output shaft 21*a*.

The torque calculator 77 is one of the function blocks implemented by software processing executed by the CPU 56*a*. The torque calculator 77 calculates a torque based on the torque detection signal from the torque sensor 42, and outputs the calculated torque to the PWM generator 75. The torque corresponds to a value of the torque indicated by the torque detection signal, and corresponds to the magnitude of the load applied to the motor 21. The PWM generator 75 generates the PWM signal further based on the torque calculated by the torque calculator 77.

The output limit process of the third embodiment will be described with reference to FIG. 15.

The CPU 56*a*, when starting the output limit process, calculates the present torque in S610. The step of S610 corresponds to a function of the aforementioned torque calculator 77.

In S620, the CPU 56*a* determines whether the torque calculated in S610 is equal to or greater than a second threshold. The second threshold may be, for example, set in advance. When the torque is smaller than the second threshold, the CPU 56*a* terminates the output limit process.

When the torque is equal to or greater than the second threshold, the CPU 56*a* proceeds to S630. In S630, the CPU 56*a* calculates a torque error TD. The torque error TD corresponds to a difference between the present torque and the second threshold. Specifically, the CPU 56*a* calculates the torque error TD by subtracting the second threshold from the torque calculated in S610. The CPU 56*a* stores the calculated torque error TD in a fourteenth memory area. The fourteenth memory area may be provided, for example, in the RAM 56*c*.

In S640, the CPU 56*a* increases the target limit value LS. Specifically, the CPU 56*a* calculates the new target limit value LS by adding the decremental speed IS to the value presently stored in the first memory area (target limit value LS). The decremental speed IS may be, for example, set in advance. The CPU 56*a* stores the calculated new target limit value LS in the first memory area.

In S650, the CPU 56*a* increases the output limit value LD. Specifically, the CPU 56*a* calculates the new output limit value LD by adding the decremental duty ratio ID to the value presently stored in the second memory area (output limit value LD). The decremental duty ratio ID may be, for example, set in advance. The CPU 56*a* stores the new output limit value LD in the second memory area.

In the driver 1 configured as above, the output of the motor 21 is limited when the torque reaches the second threshold. Thus, continuous application of the large load due to the output of the motor (for example, load equal to or greater than the magnitude corresponding to the torque of the second threshold) to the motor 21 is inhibited. Thus, damages to the driver 1 can be inhibited.

The torque being equal to or greater than the second threshold may indicate that the anvil 29 is locked (or fixed). The control circuit 56 may determine whether the anvil 29 is locked while the motor 21 is controlled to be driven. When the torque is equal to or greater than the second threshold, the control circuit 56 may determine that the anvil 29 is locked. The control circuit 56 may limit the output of the motor 21 when determining that the anvil 29 is locked.

In the driver 1 configured as above, the output of the motor 21 is limited when the anvil 29 is locked. Thus, continuous application of the large load due to the output of the motor 21 to the motor 21 is inhibited when the anvil 29 is locked. Damages to the driver 1 can be inhibited.

In the above-described embodiment, the torque calculated by the torque calculator 77 corresponds to an example of the first physical quantity of the present disclosure. The second threshold corresponds to an example of the threshold. Determining in S620 that the torque is equal to or greater than the second threshold corresponds to an example of establishment of the preset condition of the present disclosure. Determining that the anvil 29 is locked corresponds to an example of establishment of the preset condition of the present disclosure.

Fourth Embodiment

Further another example of the output control process will be described with reference to FIG. 16. As shown in FIG. 16, the same reference numerals as those in the third embodiment shown in FIG. 15 are given to the steps common to those in the output control process of the third embodiment. Hereinafter, differences from FIG. 15 will be described.

Figure 15:
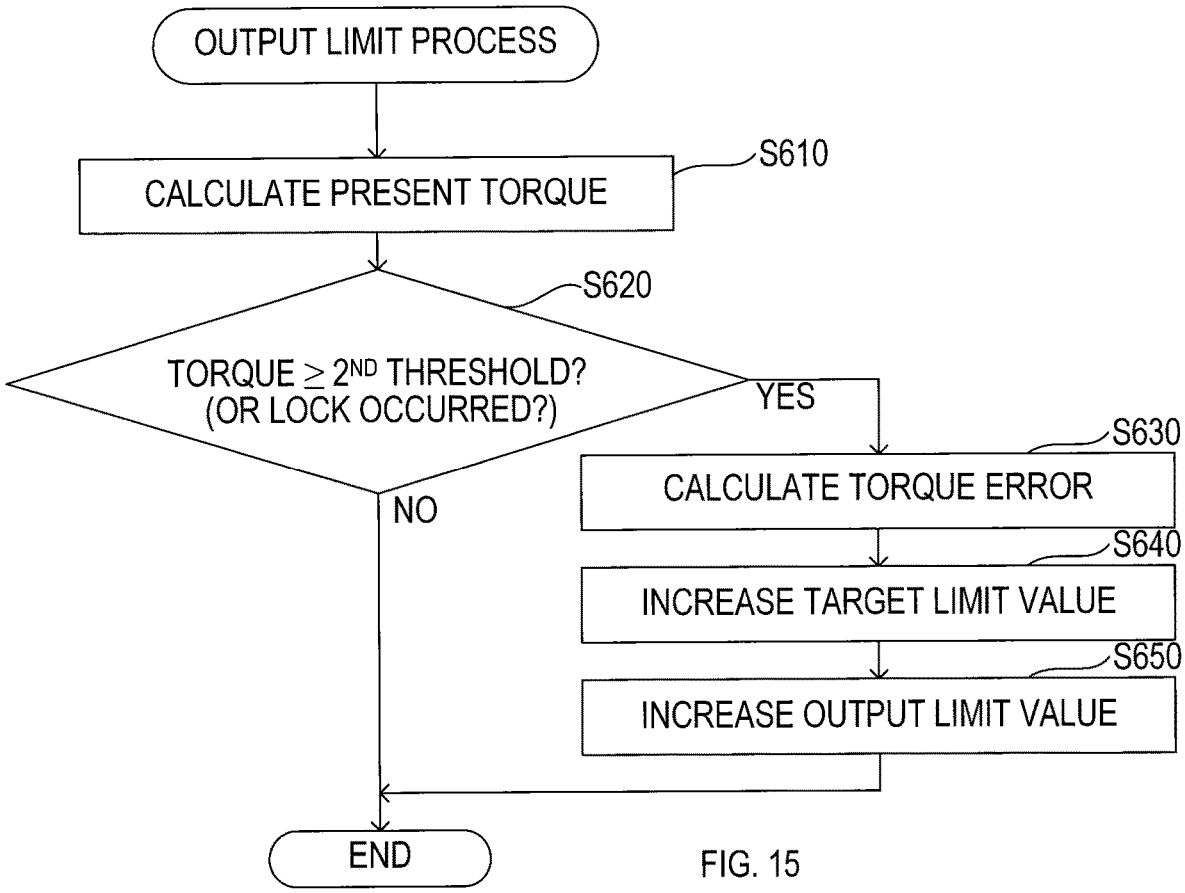
FIG. 15 is a flowchart showing the output limit process of the third embodiment.
Figure 16:
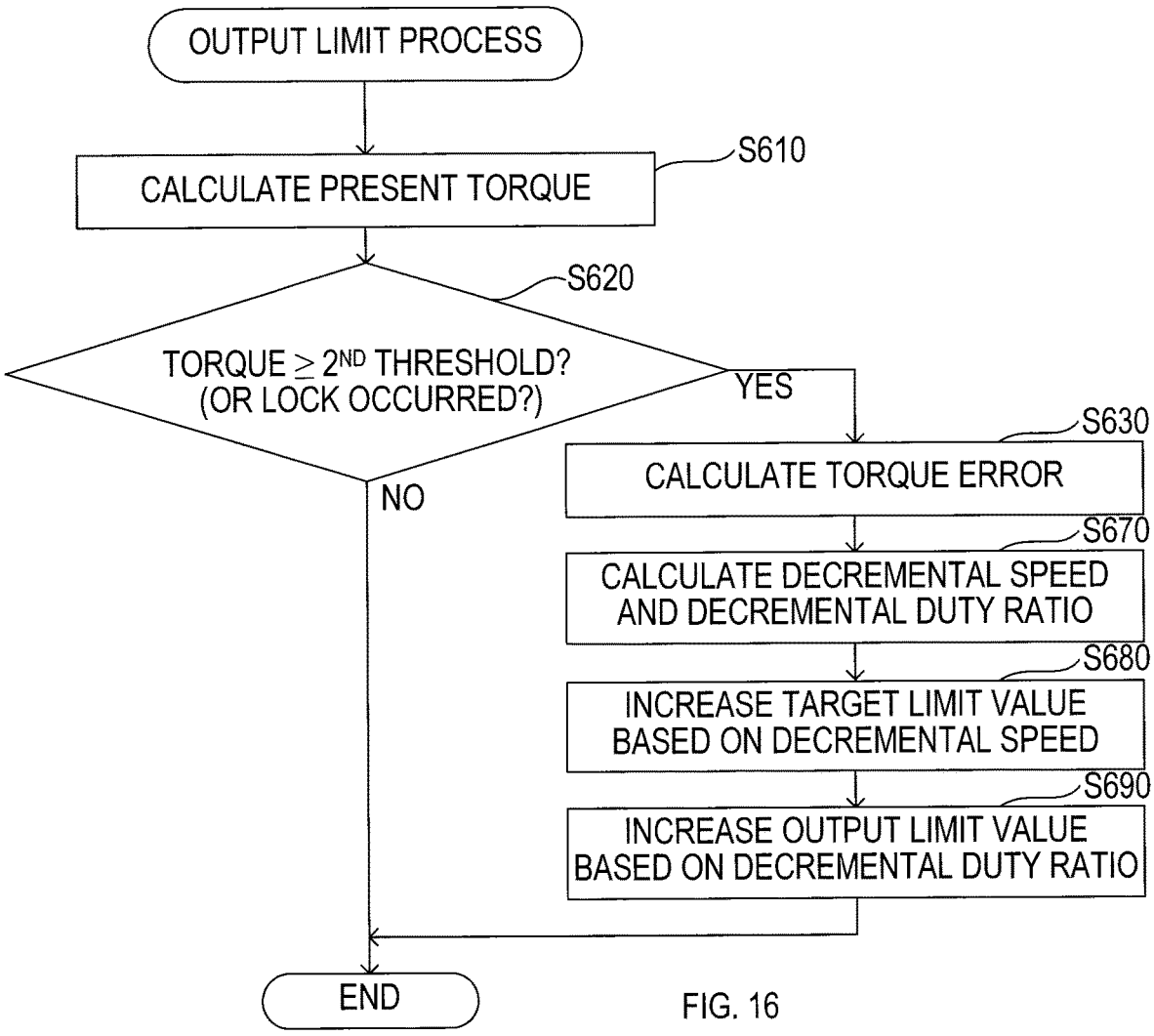
FIG. 16 is a flowchart showing the output limit process of the fourth embodiment.

As shown in FIG. 16, the output limit process of the fourth embodiment excludes the steps of S640 and S650 of the output limit process in FIG. 15, and includes additional steps of S670, S680, and S690.

In the fourth embodiment, the CPU 56*a* proceeds to S670 after the step of S630. In S670, the decremental speed IS and the decremental duty ratio ID are calculated. The decremental speed IS is calculated by multiplying the first gain ISG by the torque error TD. The CPU 56*a* stores the calculated decremental speed IS in the twelfth memory area. The first gain ISG may be, for example, set in advance. The torque error TD is stored in the fourteenth memory area. The decremental duty ratio ID is calculated by multiplying the second gain IDG by the torque error TD. The CPU 56*a* stores the calculated decremental duty ratio ID in the thirteenth memory area. The second gain IDG may be set in advance.

In S680, the CPU 56*a* increases the target limit value LS based on the decremental speed IS. Specifically, the CPU 56*a* adds the decremental speed IS stored in the twelfth memory area to the target limit value LS stored in the first memory area. The target limit value LS increased as such is stored in the first memory area.

In S690, CPU 56*a* increases the output limit value LD based on the decremental duty ratio ID. Specifically, the CPU 56*a* adds the decremental duty ratio ID stored in the thirteenth memory area to the output limit value LD stored in the second memory area. The output limit value LD increased as such is stored in the second memory area.

Fifth Embodiment

Figure 17:
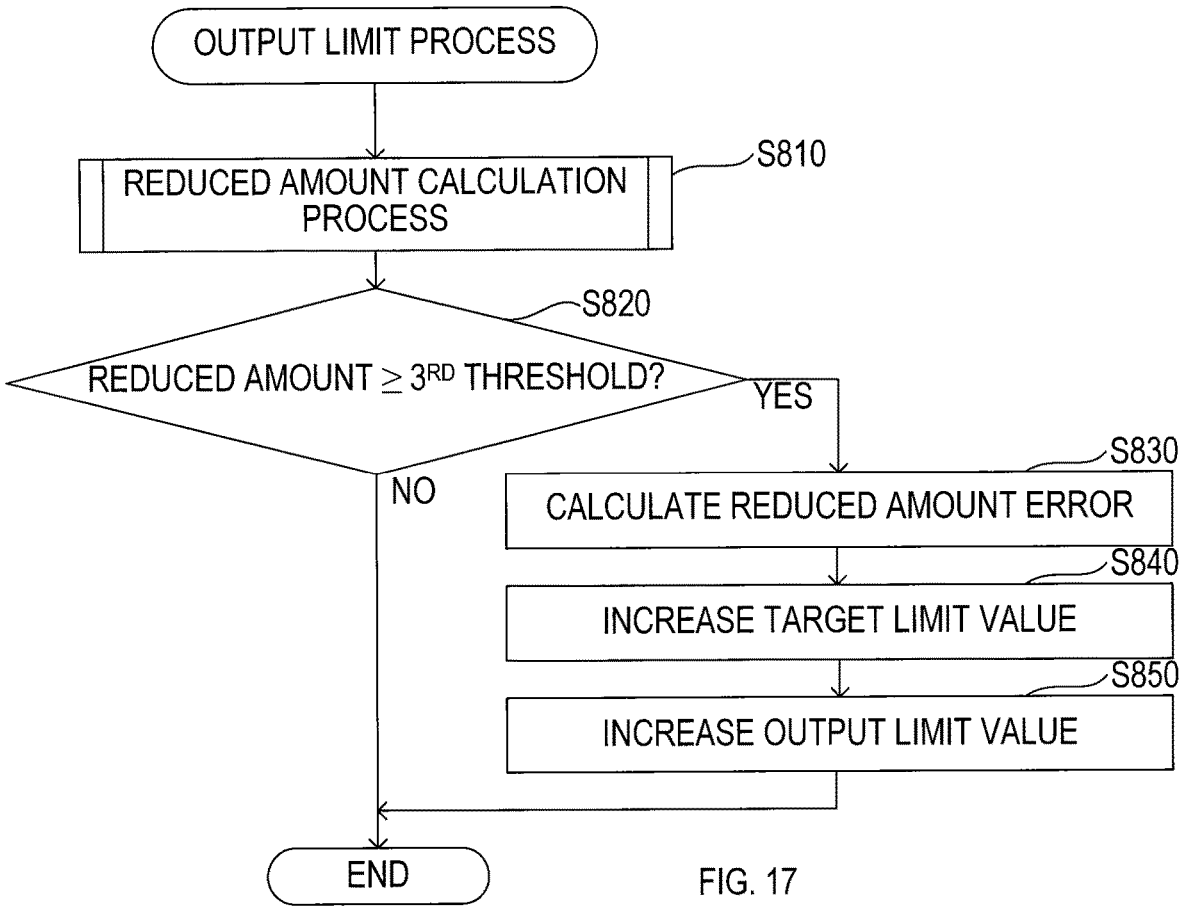
FIG. 17 is a flowchart showing the output limit process of the fifth embodiment.

The driver 1 of the fifth embodiment will be described with reference to FIGS. 17 to 19. In the fifth embodiment, the output limit process shown in FIG. 17 is different from the output limit process of the first embodiment shown in FIG. 8 in its detail. Hereinafter, differences from the first embodiment will be described. In the following description, the same reference numerals as those in the first embodiment are given to the components common to those of the first embodiment.

As shown in FIG. 17, the CPU 56*a*, when starting the output limit process, executes a reduced amount calculation process in S810. The reduced amount calculation process includes a step of calculating a reduced amount DS. The reduced amount DS indicates a reduced amount of the motor speed per unit time, and corresponds to the magnitude of the load applied to the motor 21.

In S820, the CPU 56*a* determines whether the reduced amount DS calculated in S810 is equal to or greater than a third threshold. The third threshold may be, for example, set in advance. When the reduced amount DS is smaller than the third threshold, the CPU 56*a* terminates the output limit process.

When the reduced amount DS is equal to or greater than the third threshold, the CPU 56*a* proceeds to S830. In S830, the CPU 56*a* calculates a reduced amount error DRD. The reduced amount error DRD corresponds to a difference between the present reduced amount DS and the third threshold. Specifically, the CPU 56*a* calculates the reduced amount error DRD by subtracting the third threshold from the reduced amount DS calculated in S810 (i.e., value stored in a later-described seventeenth memory area). The CPU 56*a* stores the calculated reduced amount error DRD in a fifteenth memory area. The fifteenth memory area may be provided, for example, in the RAM 56*c*.

In S840, the CPU 56*a* increases the target limit value LS. Specifically, the CPU 56*a* calculates the new target limit value LS by adding the decremental speed IS to the value presently stored in the first memory area (target limit value LS). The decremental speed IS may be, for example, set in advance. The CPU 56*a* stores the calculated new target limit value LS in the first memory area.

In S850, the CPU 56*a* increases the output limit value LD. Specifically, the CPU 56*a* calculates the new output limit value LD by adding the decremental duty ratio ID to the value presently stored in the second memory area (output limit value LD). The decremental duty ratio ID may be, for example, set in advance. The CPU 56*a* stores the new output limit value LD in the second memory area.

Figure 18:
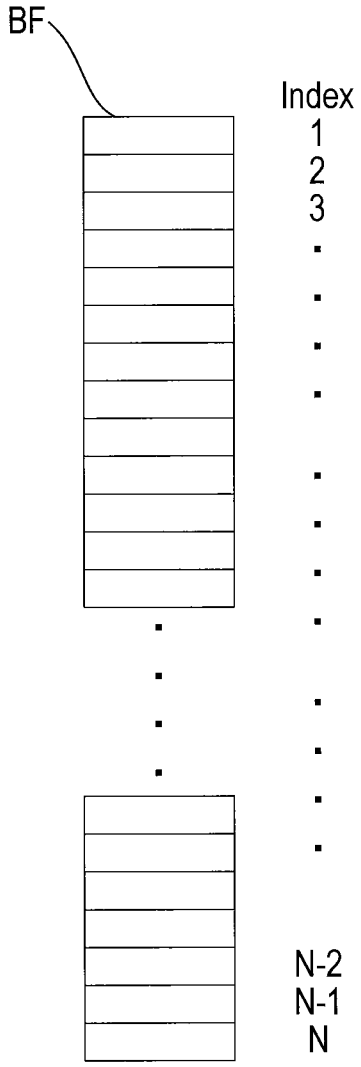
FIG. 18 is a diagram showing a configuration of a speed buffer.
Figure 19:
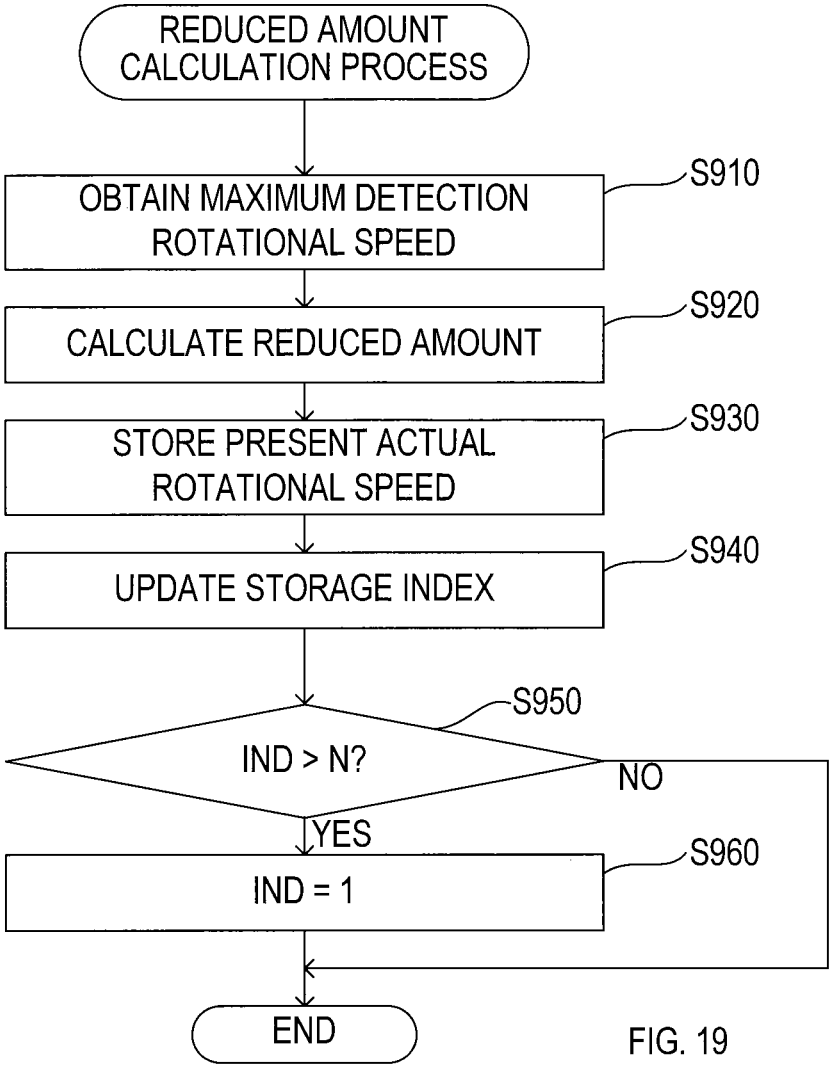
FIG. 19 is a flowchart showing a reduced amount calculation process.

The RAM 56*c* is provided with a speed buffer BF illustrated in FIG. 18. In other words, the speed buffer BF includes n storage areas. Each of the n storage areas has a storage index. The storage index identifies the corresponding storage area. Specifically, each of the N storage areas is assigned with a different integer from 1 to N as a storage index value IND. The speed buffer BF stores N motor speed values at the maximum detected (calculated) most recently. Specifically, each time a later-described step of S930 is executed, the speed buffer BF stores the actual rotational speed.

Details of the reduced amount calculation process in S810 will be described with reference to FIG. 19.

The CPU 56*a*, when starting the reduced amount calculation process, extracts the maximum motor speed (hereinafter, "maximum detection speed MS") stored in the speed buffer BF in S910. The CPU 56*a* stores the extracted maximum detection speed MS in a sixteenth memory area. The sixteenth memory area may be provided, for example, in the RAM 56*c*.

In S920, the CPU 56*a* calculates the reduced amount DS. The reduced amount DS is calculated by subtracting the actual rotational speed from the value stored in the sixteenth memory area (maximum detection speed MS). The CPU 56*a* stores the calculated reduced amount DS in a seventeenth memory area. The seventeenth memory area may be provided, for example, in the RAM 56*c*.

In S930, the CPU 56*a* obtains the actual rotational speed and stores the actual rotational speed in the speed buffer BF. The RAM 56*c* stores the storage index value IND. An initial value of the storage index value IND is, for example, one (1). Thus, when the tool control process is started and the step of S930 is initially executed, the storage index value IND is set to one (1). In S930, the CPU 56*a* stores the actual rotational speed in a storage area of the speed buffer BF corresponding to the storage index value IND stored in the RAM 56*c*.

In S940, the CPU 56*a* increments the storage index value IND (for example, by 1).

In S950, the CPU 56*a* determines whether the storage index value IND stored in the RAM 56*c* exceeds the number N of the storage areas of the speed buffer BF (hereinafter, "buffer storage number N"). When the storage index value IND does not exceed the buffer storage number N, the CPU 56*a* terminates the reduced amount calculation process. When the storage index value IND exceeds the buffer storage number N, the CPU 56*a* proceeds to S960. In S960, the CPU 56*a* sets the storage index value IND to one (1) (i.e., initializes the storage index value IND), and terminates the reduced amount calculation process.

In the driver 1 configured as above, the control circuit 56 limits the output of the motor 21 when the reduced amount DS is equal to or greater than the third threshold. The buffer storage number N corresponds to the unit time. Thus, continuous application of the large load due to the output of the motor (for example, a load equal to or greater than a magnitude corresponding to the reduced amount DS of the third threshold) to the motor 21 is inhibited. Damages to the driver 1 can be inhibited.

In the above-described embodiment, the reduced amount DS corresponds to an example of the first physical quantity of the present disclosure. The third threshold corresponds to the threshold of the present disclosure. Determining in S820 that the reduced amount DS is equal to or greater than the third threshold corresponds to an example of establishment of the preset condition of the present disclosure.

Sixth Embodiment

Further another example of the output limit process will be described with reference to FIG. 20. In the output limit process shown in FIG. 16, the same reference numerals as those in the fifth embodiment shown in FIG. 17 are given to the steps common to those in the output limit process of the fifth embodiment. Hereinafter, differences from FIG. 17 will be described.

Figure 20:
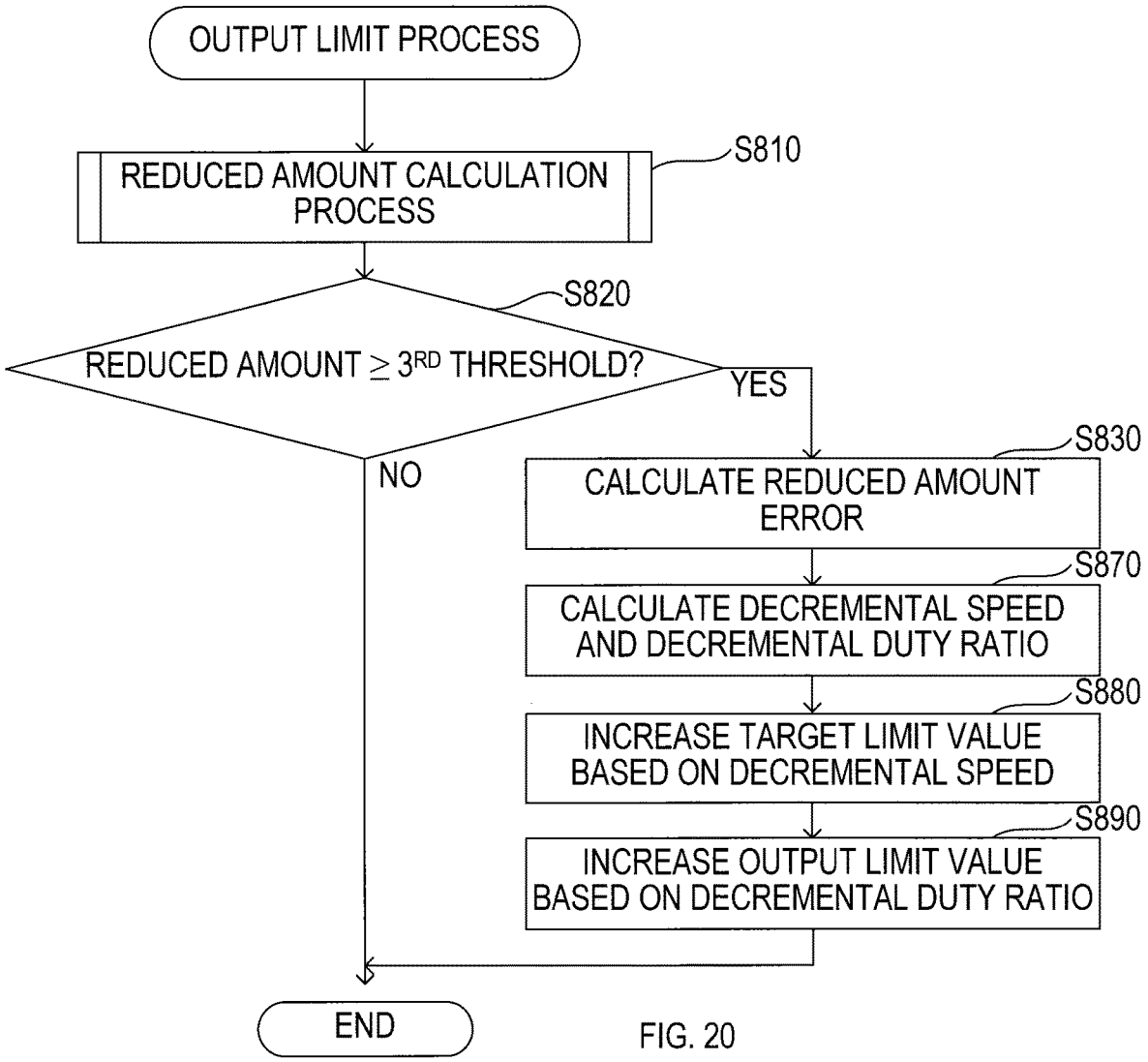
FIG. 20 is a flowchart showing the output limit process of the sixth embodiment.

As shown in FIG. 20, the output limit process of the sixth embodiment excludes the steps of S840 and S850 in the output limit process of FIG. 17, and includes additional steps of S870, S880, and S890.

In the sixth embodiment, the CPU 56*a* proceeds to S870 after the step of S830. In S870, the decremental speed IS and the decremental duty ratio ID are calculated. The decremental speed IS is calculated by multiplying the first gain ISG by the reduced amount error DRD. The CPU 56*a* stores the calculated decremental speed IS in the twelfth memory area. The first gain ISG may be, for example, set in advance. The reduced amount error DRD is stored in the fifteenth memory area. The decremental duty ratio ID is calculated by multiplying the second gain IDG by the reduced amount error DRD. The CPU 56*a* stores the calculated decremental duty ratio ID in the thirteenth memory area. The second gain IDG may be set in advance.

In S880, the CPU 56*a* increases the target limit value LS based on the decremental speed IS. Specifically, the CPU 56*a* adds the decremental speed IS stored in the twelfth memory area to the target limit value LS stored in the first memory area. The target limit value LS increased as such is stored in the first memory area.

In S890, the CPU 56*a* increases the output limit value LD based on the decremental duty ratio ID. Specifically, the CPU 56*a* adds the decremental duty ratio ID stored in the thirteenth memory area to the output limit value LD stored in the second memory area. The output limit value LD increased as such is stored in the second memory area.

Although the embodiments of the present disclosure have been described above, the present disclosure is not limited to the above-described embodiments, but may be practiced in various forms.

For example, in the aforementioned embodiments, each time the preset condition is established, the target limit value LS and the output limit value LD are sequentially increased. The preset condition is established when the current value reaches the first threshold, when the torque reaches the second threshold, when the reduced amount DS reaches the third threshold, and/or when the anvil is locked. However, after the target limit value LS and the output limit value are increased a specified number of times, the target limit value LS and the output limit value LD may be maintained even if the preset condition is established. Also, after the target limit value LS and the output limit value LD are increased the specified number of times, the motor 21 may be stopped.

Two or more functions of one element in the aforementioned embodiment may be achieved by two or more elements; or one function of one element in the aforementioned embodiment may be achieved by two or more elements. Likewise, two or more functions of two or more elements may be achieved by one element; or one function achieved by two or more elements may be achieved by one element. A part of the configuration of the aforementioned embodiment may be omitted; and at least a part of the configuration of the aforementioned embodiment may be added to or replaced with another part of the configuration of the aforementioned embodiment.

In addition to the above-described driver 1, the present disclosure may be practiced in various modes such as a program enabling a computer to function as the control circuit 56, a non-transitory tangible storage medium, such as a semiconductor memory, storing the program, and a tool control method.

What is claimed is:

1. An electric power tool comprising:

a motor;

an impact mechanism including a hammer and an anvil, the hammer being configured to be rotated by the motor, the anvil being configured to rotate in response to receiving a rotational force of the hammer, the anvil being configured to be attached to a tool bit, the hammer being configured to impact the anvil in a rotation direction of the hammer in response to receipt of a first torque by the anvil, and the first torque being equal to or greater than a preset magnitude;

a drive circuit configured to supply an electric power to the motor to thereby drive the motor; and a control circuit electrically connected to the drive circuit and configured to execute a motor control process, the motor control process including:

setting a magnitude of the electric power to a first magnitude;

switching the magnitude of the electric power from the first magnitude to a second magnitude in response to establishment of a preset condition, the second magnitude being smaller than the first magnitude and greater than zero, and the preset condition being based on a magnitude of a load applied to the motor; and switching the magnitude of the electric power from the second magnitude to a third magnitude in response to (i) switching the magnitude of the electric power to the second magnitude and (ii) establishment of the preset condition, the third magnitude being smaller than the first magnitude and the second magnitude and greater than zero.

2. The electric power tool according to claim 1, wherein the preset condition is established in response to a first physical quantity reaching a threshold, the threshold being preset, the first physical quantity indicating the magnitude of the load.

3. The electric power tool according to claim 2, wherein the magnitude of the load corresponds to a magnitude of the torque applied to the anvil.

4. The electric power tool according to claim 2, wherein the magnitude of the load corresponds to a magnitude of an electric current supplied to the motor.

5. The electric power tool according to claim 2, wherein the magnitude of the load corresponds to a reduced amount per unit time of an actual rotational speed of the motor.

6. The electric power tool according to claim 2, wherein the control circuit is configured to control the magnitude of the electric power based on a pulse width modulation (PWM) signal, the PWM signal having a duty ratio, and switching the magnitude of the electric power in response to the first physical quantity reaching the threshold includes reducing the duty ratio.

7. The electric power tool according to claim 1, wherein the preset condition is established in response to lock of the anvil.

8. The electric power tool according to claim 7, wherein the control circuit is configured to determine whether the lock has occurred, and the preset condition is established in response to the control circuit determining that the lock has occurred.

9. The electric power tool according to claim 8, wherein the control circuit is configured to determine whether the lock has occurred based on the torque applied to the anvil.

10. The electric power tool according to claim 1, wherein the motor control process includes controlling the drive circuit so that an actual rotational speed of the motor is consistent with a target rotational speed, and switching the magnitude of the electric power in response to establishment of the preset condition includes reducing the target rotational speed.

11. The electric power tool according to claim 1, wherein the motor control process further includes:

determining the first magnitude so that an actual rotational speed of the motor is consistent with a first target rotational speed, and in response to establishment of the preset condition, (i) determining the magnitude of the electric power so that the actual rotational speed is consistent with a second target rotational speed, and (ii) reducing a determined magnitude of the electric power based on the magnitude of the load applied to the motor to thereby determine the second magnitude; and the second target rotational speed is lower than the first target rotational speed.

12. The electric power tool according to claim 11, further comprising:

a trigger configured to be pulled by a user of the electric power tool, wherein the motor control process further includes obtaining the first target rotational speed corresponding to a pulling amount of the trigger pulled by the user and the second target rotational speed corresponding to the pulling amount of the trigger pulled by the user.

13. The electric power tool according to claim 1, wherein the control circuit is configured to output a drive signal to the drive circuit to thereby control supply of the electric power to the motor, the drive signal is a pulse width modulation signal having a duty ratio, and the control circuit is configured to set or vary the duty ratio based on the magnitude of the electric power.

14. An electric power tool comprising:

a motor;

an impact mechanism including a hammer and an anvil, the hammer being configured to be rotated by the motor, the anvil being configured to rotate in response to receiving a rotational force of the hammer, the anvil being configured to be attached to a tool bit, the hammer being configured to impact the anvil in a rotation direction of the hammer in response to receipt of a first torque by the anvil, and the first torque being equal to or greater than a preset magnitude;

a drive circuit configured to supply an electric power to the motor to thereby drive the motor; and a control circuit electrically connected to the drive circuit and configured to execute a motor control process, the motor control process including:

setting a magnitude of the electric power to a first magnitude;

switching the magnitude of the electric power from the first magnitude to a second magnitude in response to establishment of a preset condition, the second magnitude being smaller than the first magnitude and greater than zero, and the preset condition being based on a magnitude of a load applied to the motor;

switching the magnitude of the electric power from the second magnitude to a third magnitude in response to (i) switching the magnitude of the electric power to the second magnitude and (ii) establishment of the preset condition, the third magnitude being smaller than the first magnitude and the second magnitude and greater than zero; and switching the magnitude of the electric power from the third magnitude to a fourth magnitude in response to (i) switching the magnitude of the electric power to the third magnitude and (ii) establishment of the preset condition, the fourth magnitude being smaller than the first magnitude, the second magnitude and the third magnitude and greater than zero.

* * * * *